US010792579B2

(12) United States Patent
Hashemi et al.

(10) Patent No.: US 10,792,579 B2
(45) Date of Patent: Oct. 6, 2020

(54) TOY ASSEMBLY WITH CHARACTER IN HOUSING AND MECHANISM TO OPEN HOUSING WITH TETHER

(71) Applicant: SPIN MASTER LTD., Toronto (CA)

(72) Inventors: Hamid R. Hashemi, Mississauga (CA); Ian Patterson, Innisfil (CA); Goran Markovic, Toronto (CA); William Benedict Camacho, Markham (CA); Jay Vogler, Toronto (CA); Edwin Steele, Etobicoke (CA)

(73) Assignee: SPIN MASTER LTD., Toronto (CA)

( * ) Notice: Subject to any disclaimer, the term of this patent is extended or adjusted under 35 U.S.C. 154(b) by 0 days.

(21) Appl. No.: 16/739,840

(22) Filed: Jan. 10, 2020

(65) Prior Publication Data

US 2020/0222819 A1 Jul. 16, 2020

Related U.S. Application Data

(60) Provisional application No. 62/791,744, filed on Jan. 12, 2019, provisional application No. 62/909,790, filed on Oct. 3, 2019.

(51) Int. Cl.

| | |
|---|---|
| ***A63H 3/00*** | (2006.01) |
| ***A63H 3/36*** | (2006.01) |
| ***A63H 29/22*** | (2006.01) |
| ***A63H 3/50*** | (2006.01) |
| ***A63H 13/16*** | (2006.01) |

(52) U.S. Cl.

CPC ..... *A63H 3/36* (2013.01); *A63H 3/50* (2013.01); *A63H 13/16* (2013.01); *A63H 29/22* (2013.01); *A63H 2200/00* (2013.01)

(58) Field of Classification Search

CPC . A63H 3/50; A63H 13/16; B65D 5/42; B65D 5/64; B65D 2590/664

See application file for complete search history.

(56) References Cited

U.S. PATENT DOCUMENTS

| | | | | |
|---|---|---|---|---|
| 3,623,263 A * | 11/1971 | Frampton | A63H 13/16 446/310 |
| 4,259,805 A | 4/1981 | Hornsby, Jr. | |
| 4,729,490 A * | 3/1988 | Ziegenbein | B65F 1/1638 220/211 |
| 5,329,212 A * | 7/1994 | Feigleson | B65F 1/1638 220/260 |
| 5,765,748 A * | 6/1998 | Chen | B65D 5/68 229/125.22 |

(Continued)

FOREIGN PATENT DOCUMENTS

| | | |
|---|---|---|
| CN | 207913232 U | 9/2018 |
| EP | 3132835 A2 | 2/2017 |
| WO | 2010/045268 A2 | 4/2010 |

OTHER PUBLICATIONS

EP20151312, European Search Report, European Patent Office, dated May 18, 2020.

*Primary Examiner* — John A Ricci

(74) *Attorney, Agent, or Firm* — Millman IP Inc.

(57) ABSTRACT

In an aspect, a toy assembly is provided, and includes a housing, an inner object (which may, in some embodiments, represent a character) inside the housing, a tether, and a motor. The tether is driven by the motor to pull at least one removable housing portion from the housing.

20 Claims, 26 Drawing Sheets

(56) References Cited

U.S. PATENT DOCUMENTS

| | | | | |
|---|---|---|---|---|
| 6,544,097 | B1 * | 4/2003 | Bain | A63H 3/28<br>446/297 |
| 7,726,552 | B2 * | 6/2010 | Chadima | B65D 5/685<br>229/102 |
| 2019/0160385 | A1 * | 5/2019 | McDonald | A63H 3/50 |

* cited by examiner

TOY ASSEMBLY WITH CHARACTER IN HOUSING AND MECHANISM TO OPEN HOUSING WITH TETHER

CROSS REFERENCE TO RELATED APPLICATIONS

This application claims the benefit of U.S. Provisional Application No. 62/791,744 filed Jan. 12, 2019, and of U.S. Provisional Application No. 62/909,790 filed Oct. 3, 2019, the contents of both of which are incorporated herein by reference in their entirety.

FIELD

The specification relates generally to assemblies with inner objects that break out of housings.

BACKGROUND OF THE DISCLOSURE

There is a market desire for toys wherein there is some element of surprise in terms of what toy a user will end up with upon purchase. An example of such a toy is the Hatchimals line of products made and sold by Spin Master Ltd. There is also a desire for toys that at least appear to release themselves from the housings in which they reside, which in some instances lends an air of reality to the toy, whether or not the user knows which toy they are getting.

SUMMARY OF THE DISCLOSURE

In an aspect, a toy assembly is provided and includes a housing having a main housing portion, and a first set of at least one removable housing portion that is at least partially removable from the main housing portion; a first series of eyelets mounted to the first set of at least one removable housing portion; an inner object inside the housing; a motor that is connected to drive at least one drum; a first anchor having a first anchor slot having a first exit and a second exit; a first tether having a free end which has an engagement member that is unable to pass through the first exit of the first anchor slot but can pass through the second exit of the first anchor slot, wherein the first tether passes sequentially through each of the series of eyelets between the at least one drum and the first anchor; wherein, in an initial state the engagement member is positioned in the first anchor slot at the first exit of the first anchor slot, wherein, for each eyelet in succession in the first series of eyelets, a first segment of the first tether is angled relative to the eyelet and a final segment of the first tether is angled relative to the first anchor slot such that rotation of the motor to wind the first tether on the at least one drum pulls the free end of the first tether towards the first exit of the first anchor slot, and applies a first removal force on each eyelet in succession, wherein the first removal force is sufficiently strong to remove a portion of the first set of at least one removable housing portion from the main housing portion, and wherein after applying the first removal force to a final eyelet from the first series of eyelets, the first tether is angled such that rotation of the motor to wind the first tether on the at least one drum pulls the free end of the first tether towards and through the second exit of the first anchor slot, so as to remove the first tether from the first anchor.

In another aspect, a toy assembly is provided and includes: a housing; an inner object inside the housing; an opening member that is positioned in the housing and is positioned to open the housing to expose the inner object; a motor that is connected to drive the opening member to open the housing, wherein the inner object is removable from the housing and wherein the motor is inside the inner object, and wherein the housing includes a housing input member thereon, and a housing electrical terminal in the housing is in electrical communication with an inner object electrical terminal that is part of the inner object, so as to communicate actuation of the housing input member to a controller in the inner object, wherein the controller is connected to the motor to control operation of the motor based on actuation of the housing input member, wherein the motor drives an inner object output shaft that is inside the inner object, and wherein the opening member is at least partially outside of the inner object, wherein the housing includes a housing input shaft that is operatively connected to the opening member, wherein the housing input shaft removably extends into the inner object to engage the inner object output shaft such that rotation of the motor drives the housing input shaft, which in turn drives the opening member to open the housing.

In yet another aspect, a toy assembly is provided, and includes: a housing having a main housing portion, and a first tear strip that is at least partially removable from the main housing portion; an inner object inside the housing; a motor that drives at least one drum; a first tether positioned to apply a first removal force to the first tear strip, wherein the housing has a first side, a second side, and a third side, wherein the second side and the third side are each adjacent the first side, wherein, for each side of the first, second and third sides, the housing further includes a side corner connecting said each side with any of the first, second, and third sides that are adjacent to said each side, and wherein the housing includes a top, wherein the first tear strip is a second-side tear strip extending along the second side between the first side and an opposing end of the second side, wherein the third side has a third-side tear strip extending between the first side and an opposing end of the third side, wherein the toy assembly further comprises a second tether positioned to apply a second removal force to the third-side tear strip, wherein, rotation of the motor to wind the first tether on the at least one drum and to wind the second tether on the at least one drum drives the first tether to apply the first removal force to the first tear strip and drives the second tether to apply the second removal force to the second tear strip, so as to at least partially remove the first and second tear strips from the main housing portion, wherein each of the second-side tear strip and the third-side tear strip is defined by a first tear line and a second tear line, wherein the first and second tear lines do not extend across any of the side corners.

In yet another aspect, a method of opening a toy assembly is provided, wherein the toy assembly includes a housing having a main housing portion, and a first set of at least one removable housing portion that is at least partially removable from the main housing portion, a first series of eyelets mounted to the first set of at least one removable housing portion, an inner object inside the housing, a motor that drives at least one drum, a first anchor having a first anchor slot having a first exit and a second exit, a first tether having a free end which has an engagement member that is unable to pass through the first exit of the first anchor slot but can pass through the second exit of the first anchor slot, wherein the first tether passes sequentially through each of the series of eyelets between the at least one drum and the first anchor, wherein, in an initial state the engagement member is positioned in the first anchor slot at the first exit of the first anchor slot, wherein the method comprises:

driving the motor to wind the first tether on the at least one drum and to wind the second tether on the at least one drum, wherein, during said driving, for each eyelet in succession in the first series of eyelets, a first segment of the first tether is angled relative to the eyelet and a final segment of the first tether is angled relative to the first anchor slot such that the first tether pulls the free end of the first tether towards the first exit of the first anchor slot, and applies a first removal force on each eyelet in succession in the first series of eyelets, wherein the first removal force is sufficiently strong to remove a portion of the first set of at least one removable housing portion from the main housing portion; and after applying the first removal force to a final eyelet from the first series of eyelets, driving the motor to wind the first tether on the at least one drum with the first tether angled so as to pull the free end of the first tether towards and through the second exit of the first anchor slot, so as to remove the first tether from the first anchor.

In yet another aspect, a method of opening a toy assembly is provided, wherein the toy assembly includes a housing having a main housing portion, and a first tear strip that is at least partially removable from the main housing portion, an inner object inside the housing, a motor that drives at least one drum, a first tether positioned to apply a first removal force to the first tear strip, wherein the housing has a first side, a second side, and a third side, wherein the second side and the third side are each adjacent the first side, wherein, for each side of the first, second and third sides, the housing further includes a side corner connecting said each side with any of the first, second, and third sides that are adjacent to said each side, and wherein the housing includes a top, wherein the first tear strip is a second-side tear strip extending along the second side between the first side and an opposing end of the second side, wherein the third side has a third-side tear strip extending between the first side and an opposing end of the third side, wherein the toy assembly further comprises a second tether positioned to apply a second removal force to the third-side tear strip, the method comprising:

rotating the motor to wind the first tether on the at least one drum and to wind the second tether on the at least one drum, so as to drive the first tether to apply the first removal force to the first tear strip and drives the second tether to apply the second removal force to the second tear strip, so as to at least partially remove the first and second tear strips from the main housing portion, wherein each of the second-side tear strip and the third-side tear strip is defined by a first tear line and a second tear line, wherein the first and second tear lines do not extend across any of the side corners.

In yet another aspect, a toy assembly is provided, and includes: a housing that is positionable on a support surface; an inner object inside the housing and is removable from the housing; an opening member that is positioned in the housing and is positioned to open the housing to expose the inner object; a motor that is connected to drive the opening member to open the housing; an impactor member that is separate from the opening member and that is connected to the motor to be driven by the motor between an impact position in which the impactor member impacts at least one of the housing and the support surface to cause the housing to move on the support surface and a non-impact position in which the impactor member is spaced from the at least one of the housing and the support surface.

In yet another aspect, a toy assembly is provided, and includes: a housing having a main housing portion, and a first tear strip that is at least partially removable from the main housing portion; an inner object inside the housing; a motor that drives at least one drum; a first tether positioned to apply a first removal force to the first tear strip, wherein the housing has a first side, a second side, and a third side, wherein the second side and the third side are each adjacent the first side, wherein, for each side of the first, second and third sides, the housing further includes a side corner connecting said each side with any of the first, second, and third sides that are adjacent to said each side, and wherein the housing includes a top, wherein the first tear strip is a second-side tear strip extending along the second side between the first side and an opposing end of the second side, wherein the third side has a third-side tear strip extending between the first side and an opposing end of the third side, wherein the toy assembly further comprises a second tether positioned to apply a second removal force to the third-side tear strip, wherein, rotation of the motor to wind the first tether on the at least one drum and to wind the second tether on the at least one drum drives the first tether to apply the first removal force to the first tear strip and drives the second tether to apply the second removal force to the second tear strip, so as to at least partially remove the first and second tear strips from the main housing portion, wherein each of the second-side tear strip and the third-side tear strip is defined by a first tear line and a second tear line, wherein each of the first and second tear lines includes a plurality of cut segments that extend at least partially through a thickness of the housing, and which are separated from one another by a plurality of bridges, wherein each of the first and second tear lines includes at least one tear line corner, and wherein every one of the at least one tear line corner is defined in the plurality of cut segments and not in any of the bridges.

In yet another aspect, a toy assembly is provided, and includes: a housing; an inner object inside the housing; a fastener that extends into a receiving aperture and that is visible from outside the housing; a fastener driver that urges the fastener towards discharge from the receiving aperture; a fastener locking member that is movable between a fastener locking position in which the fastener locking member holds the fastener in the receiving aperture, and a fastener release position in which the fastener locking member permits the fastener driver to drive the fastener towards discharge from the receiving aperture; a locking member driver that moves angularly about a locking member driver axis between a first locking member driver position, in which the locking member driver causes the fastener locking member to move to the fastener release position and a second locking member driver position, in which the locking member driver causes the fastener locking member to move to the fastener locking position; a motor that is rotatable to drive movement of the locking member driver between the first and second locking member driver positions.

In yet another aspect, a toy assembly is provided, and includes: a housing; an inner object inside the housing; an opening member that is positioned in the housing and is positioned to open the housing to expose the inner object; a motor that is connected to drive the opening member to open the housing, wherein the motor is inside the inner object, wherein the motor is also connected to an inner object travel mechanism in the inner object, wherein, when the inner object is in a storage position in the housing and the housing is closed, rotation of the motor drives the opening member to open the housing, and wherein after the housing is open, rotation of the motor drives the inner object travel mechanism to cause the inner object to travel in the housing away from the storage position.

In yet another aspect, a toy assembly is provided, and includes: a housing having a main housing portion, and a first set of at least one removable housing portion that is at least partially removable from the main housing portion; a first series of eyelets mounted to the first set of at least one removable housing portion; an inner object inside the housing; a motor that is connected to drive at least one drum; a first anchor; a first tether having a free end which is connected to the first anchor, wherein the first tether passes sequentially through each of the series of eyelets between the at least one drum and the first anchor; wherein the housing defines a main chamber in which the inner object is positioned, and a drum chamber containing the at least one drum, wherein the drum chamber is separated from the main chamber and communicates with the main chamber via a tether pass-through aperture, through which the first tether passes, wherein, for each eyelet in succession in the first series of eyelets, a first segment of the first tether is angled relative to the eyelet and a final segment of the first tether is angled relative to the first anchor such that rotation of the motor to wind the first tether on the at least one drum applies a first removal force on each eyelet in succession, wherein the first removal force is sufficiently strong to remove a portion of the first set of at least one removable housing portion from the main housing portion, and wherein after applying the first removal force to a final eyelet from the first series of eyelets, the first tether is angled such that rotation of the motor to wind the first tether on the at least one drum pulls the tether through the tether pass-through aperture until the tether is no longer present in the main chamber.

BRIEF DESCRIPTIONS OF THE DRAWINGS

For a better understanding of the various embodiments described herein and to show more clearly how they may be carried into effect, reference will now be made, by way of example only, to the accompanying drawings in which.

DETAILED DESCRIPTION

Figure 1:
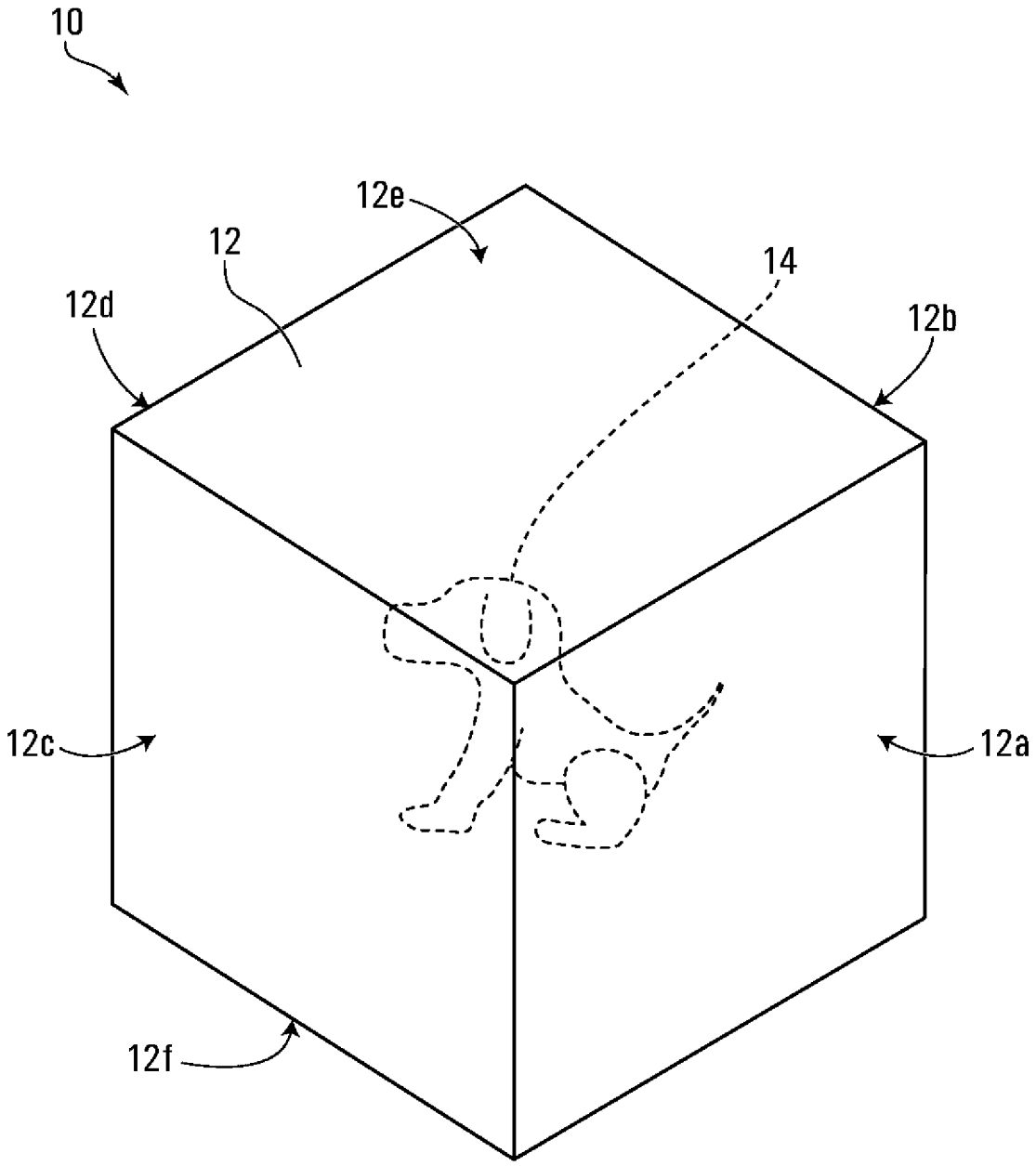
FIG. 1 is a perspective view of a toy assembly according to a non-limiting embodiment of the present disclosure.

Reference is made to FIG. 1, which shows a toy assembly 10 in accordance with an embodiment of the present disclosure. The toy assembly 10 includes a housing 12 and an inner object 14 that is positioned in the housing 12. The toy assembly 10 is, in some embodiments, configured such that the inner object 14 is a toy character, which, in the present example, is in the form of a puppy or some other animal, or some other apparently sentient entity. In some embodiments, the toy assembly 10 is configured such that it appears to the user that the inner object removes one or more portions of the housing 12 in an attempt to get out of the housing or in an attempt to get the attention of the user. Other possible forms for the inner object may be a dinosaur, a robot, a vehicle, a person, an alien, a fictitious animal such as a unicorn, or any other suitable form.

The housing 12 may have the form of a box, a crate or any other suitable form, and may have any suitable shape. In the present example, the housing 12 has first, second, third and fourth sides 12*a*, 12*b*, 12*c* and 12*d*, and has a top 12*e* and a bottom 12*f*. For each side 12*a*, 12*b*, 12*c*, 12*d* a side corner 15 connects that side 12*a*, 12*b*, 12*c*, 12*d* with any of the other of the first, second, third and fourth sides 12*a*, 12*b*, 12*c*, 12*d* that are adjacent to that side 12*a*, 12*b*, 12*c*, 12*d*. In the present example, the fourth side 12*d* is opposite the first side 12*a*, and the second side 12*b* is adjacent one end of the first side 12*a* and (in this example) connects the first and fourth sides 12*a* and 12*d*, and the third side 12*c* is opposite the second side 12*b*, is adjacent an opposing end of the first side, and also (in this example) connects the first and fourth sides 12*a* and 12*d*. The housing 12 need not have four sides, however. For example, the housing 12 could alternatively have only three sides (e.g. the form of a triangular prism). In such a case, the housing 12 would have a first side, a second side and a third side, and it would remain true that the second and third sides are adjacent respective ends of the first side, but they wouldn't connect between the first side and a fourth side—they would instead connect between the first side and each other. Alternatively, a box may have five or more sides, wherein it remains true that the box has first, second and third sides in which the second and third sides are adjacent first and second ends of the first side, and may be considered opposite one another.

Figure 2:
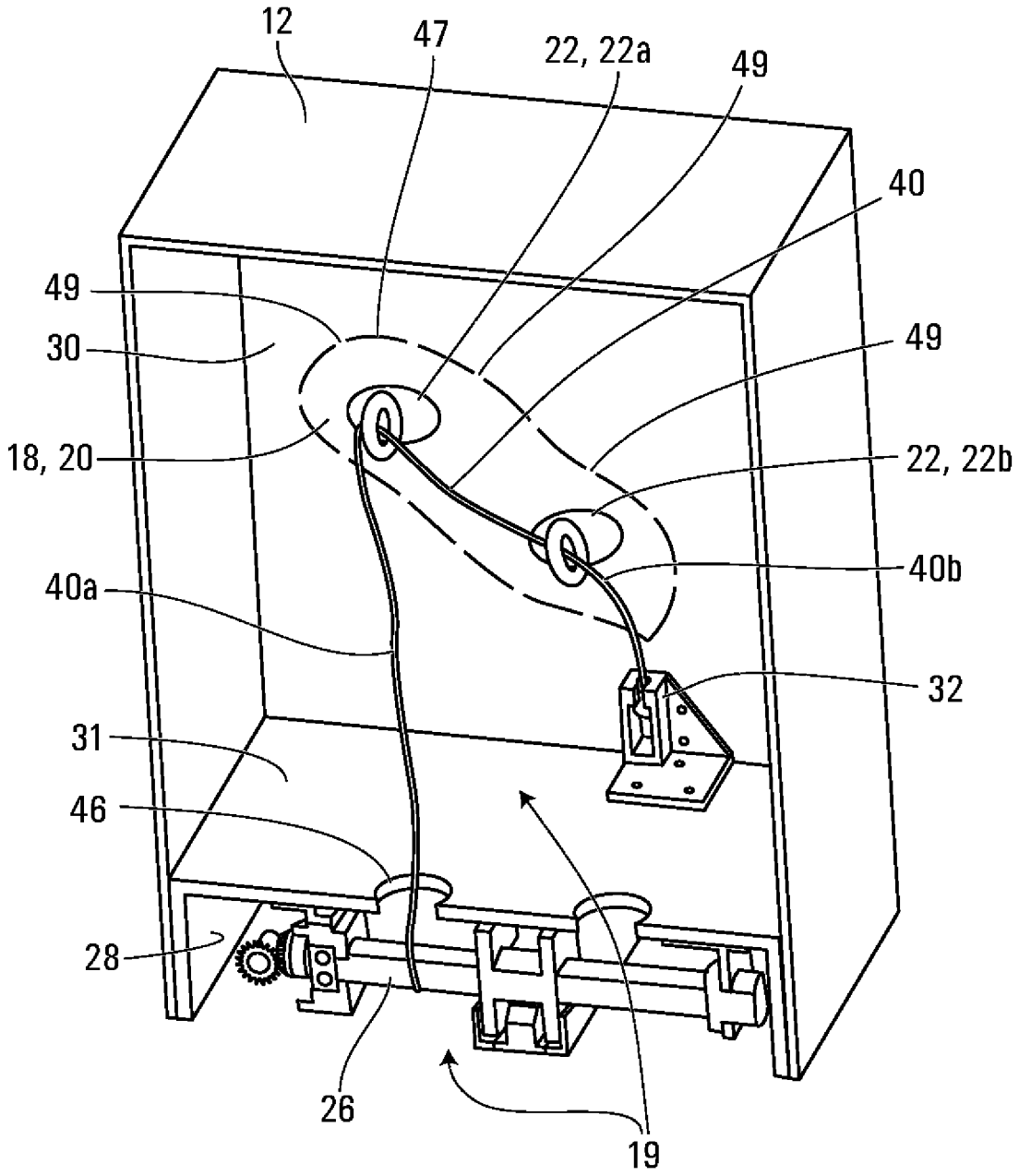
FIG. 2 is a perspective, sectional view of the toy assembly shown in FIG. 1, illustrating a housing and a mechanism employing a tether that is inside the housing to remove one or more portions of the housing in an initial state.

FIG. 2 shows the housing 12 in more detail. The housing 12 is preferably opaque so as to prevent the purchaser of the toy assembly 10 from knowing what inner object 14 they will get and from any mechanisms that are inside the housing. In an alternative embodiment, the housing 12 may partially but not fully enclose the inner object 14 so that the inner object 14 could be visible from some angles even when it is inside the housing 12.

The housing has a main housing portion 16 and a set of at least one removable housing portion 18 that is at least partially removable from the housing 12. An opening mechanism 19 is provided for at least partially removing the set of at least one removable housing portion 18, which is described further below. In the embodiment shown in FIG. 2, the set of at least one removable housing portion 18 includes one removable housing panel 20.

A first series of eyelets 22 is mounted to the set of at least one removable housing portion 18. In the embodiment shown in FIG. 2, there are two eyelets shown at 22*a* and 22*b* individually. The eyelet 22*a* is a first eyelet, and the eyelet 22*b* is a final eyelet in the series of eyelets. The eyelets 22 will be described in more detail further below.

The toy assembly 10 includes a motor 24 (FIGS. 6 and 7) that drives at least one drum 26 (FIGS. 2-5), which are part of the opening mechanism 19. In the embodiment shown, the at least one drum 26 and the motor 24 sit in a drum chamber 28, that is separate from a main chamber 30 of the housing 12, so as to obscure the motor 24 and the at least one drum 26 from the user's sight. In the present example, a platform 31 divides the housing 12 into the main chamber 30 and the drum chamber 28. The platform 31 supports the inner object 14 thereon.

It will be understood that the drum chamber 28 need not be positioned below the main chamber 30. It is alternatively possible, for example, to provide the drum chamber 28 against one side wall of the housing 12 and to be separated from the main chamber by a vertical divider, for example.

The at least one drum 26 in the present example includes a single drum 26.

The single drum 26 will be referred to as the drum 26 for readability, however it will be understood that it could be one or more drums 26 as appropriate.

The drum 26 in the present example is a generally square shaft that is used to wind a tether thereon (described later on). The drum 26 alternatively can have any other suitable shape. For example, the drum 26 could be in the form of a plastic bobbin.

Figure 5A:
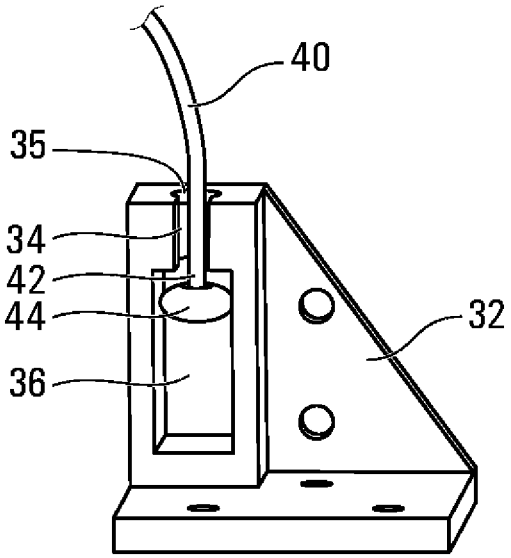
FIG. 5A is a perspective view of an anchor for the tether shown in FIG. 2 when the mechanism is in an initial state.
Figure 5B:
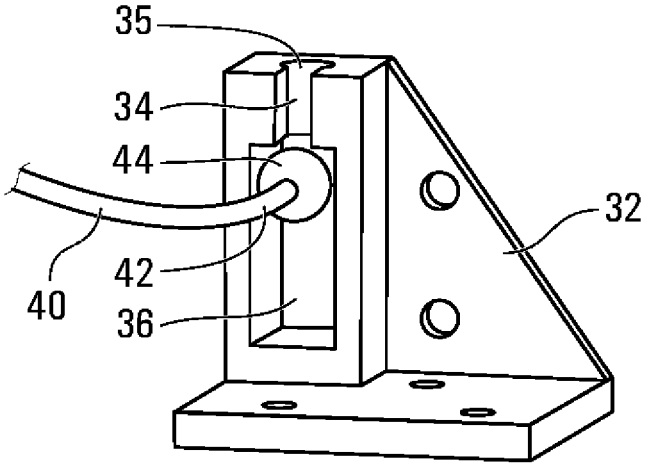
FIG. 5B is a perspective view of the anchor for the tether shown in FIG. 2 when the mechanism is removing the tether from the anchor.

A first anchor 32, which is part of the opening mechanism 19, is provided on the main housing portion 16. The first anchor 32 is shown in more detail in FIGS. 5A and 5B. The first anchor 32 has a first anchor slot 34 which has a first exit 35 and a second exit 36. As can be seen, the second exit 36 is larger than the first exit 35. A first tether 40 (which is part of the opening mechanism 19) is provided and has a connected end 41 that is connected to the drum 26 for winding of the tether 32 on the drum 26. The tether 40 has a free end 42 which has an engagement member 44 that is unable to pass through the first exit 35 of the first anchor slot 34 (as shown in FIG. 5A) but which can pass through the second exit 36 of the first anchor slot 34 (as shown in FIG. 5B). The engagement member 44 may be any suitable type of engagement member for this purpose, such as an enlargement, as shown, or such as a hook, or a knot, or any other suitable feature.

In an initial state, as shown in FIG. 2, the first tether 40 passes from the drum 26 sequentially through each of the series of eyelets 22 between the drum 26 and the first anchor 32. A tether pass-through aperture 46 is provided in the platform 31 in order to permit communication between the drum chamber 28 and the main chamber 30 (for the tether 40 to pass through from the drum chamber 28 to the main chamber 30). In the initial state the engagement member 44 is positioned in the first anchor slot at the first exit 35 of the first anchor slot 34 and is thus prevented from leaving the anchor 32.

For each eyelet in succession in the first series of eyelets 22, a first segment 40*a* of the first tether 40 is angled relative to the eyelet 22 and a final segment 40*b* of the first tether is angled relative to the first anchor slot 34 such that rotation of the motor 24 to wind the first tether 40 on the drum 26 pulls the free end 42 of the first tether 40 towards the first exit 35 of the first anchor slot 34, and applies a first removal force F1 on each eyelet 22 in succession. The first removal force F1 is sufficiently strong to remove a portion of the set of at least one removable housing portion 18 from the housing 12. The removable housing panel 20 that is shown in FIG. 2 is defined at least in part by at least one tear line 47. The at least one tear line 47 may be formed in any suitable way, such as for example, by cutting through at least a portion of the thickness of the housing 12.

Figure 12:
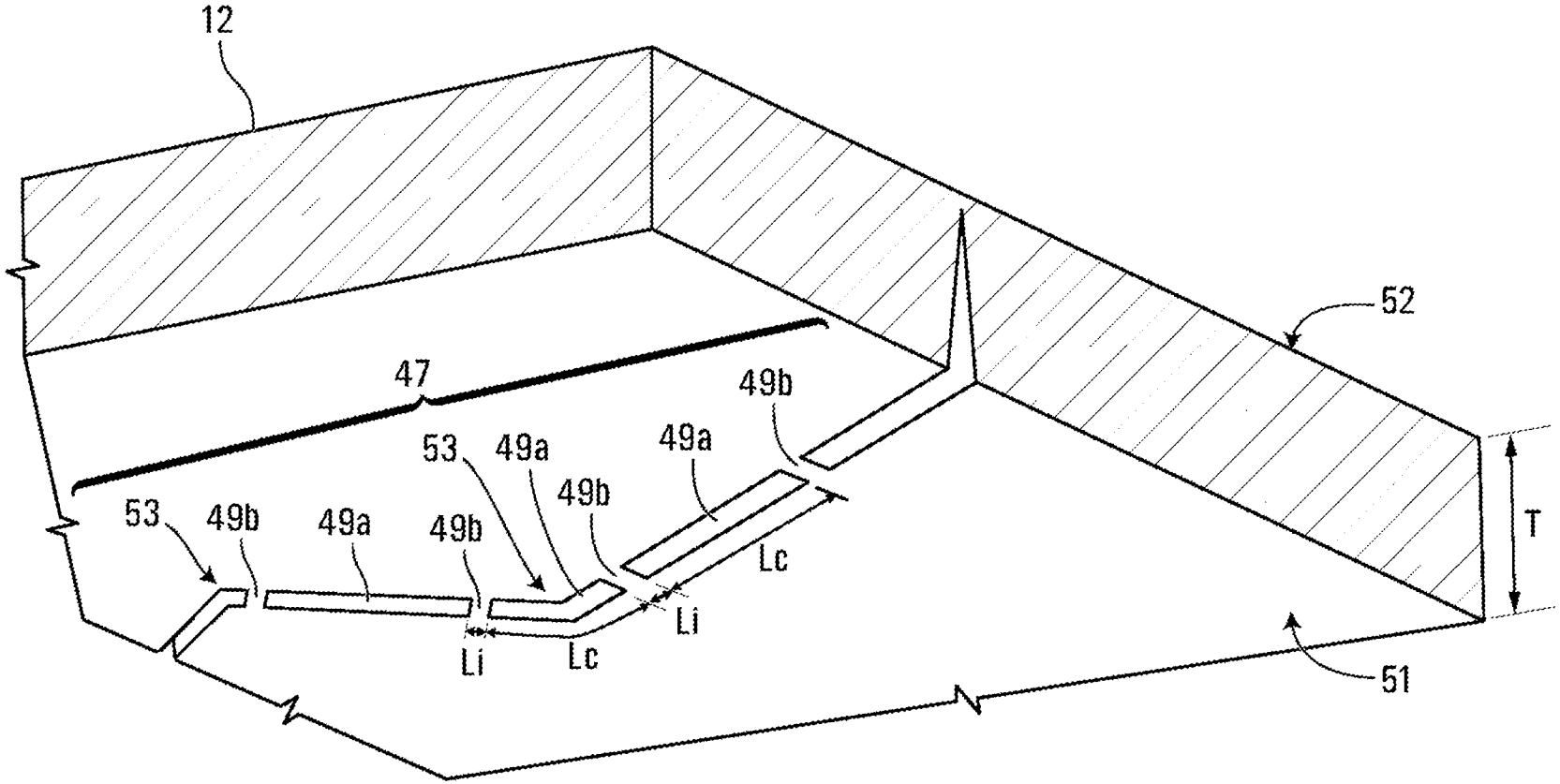
FIGS. 12-26 are further views of embodiments of the present disclosure.

An example of a portion of one of the at least one tear line 47 is shown in FIG. 12. As can be seen, the tear line 47 includes a plurality of cut segments shown at 49*a* which extend from the inner face of the housing 12 (shown at 51) through a majority of the thickness of the housing 12 to the outer face of the housing (shown at 52), and which are separated from one another by a plurality of bridges shown at 49*b*. These bridges 49*b* represent regions between the cut segments 49*a* where there is no cut in the tear line 47. The thickness of the housing 12 is represented in FIG. 12 at T. Extending 'through a majority of the thickness' means extending through more than half of the thickness. Preferably, the cut segments 49*a* extend almost all of the way though the thickness of the housing 12.

The cut segments 49*a* may have any suitable length relative to the bridges 49*b*. For example, it has been found that, for some materials, a ratio of a length Lc of each cut segment 49*a* to a length Li of each subsequent bridge next 49*b* along the tear line 47 is at least about 7:2.

It will be observed that, in some embodiments, the tear line 47 includes some tear line corners, shown at 53. In some embodiments, there are no bridges 49*b* that bridge the corners 53. In other words, every one of the tear line corners 53 is defined in the plurality of cut segments 49*a* and not in any of the bridges 49*b*.

Figure 3:
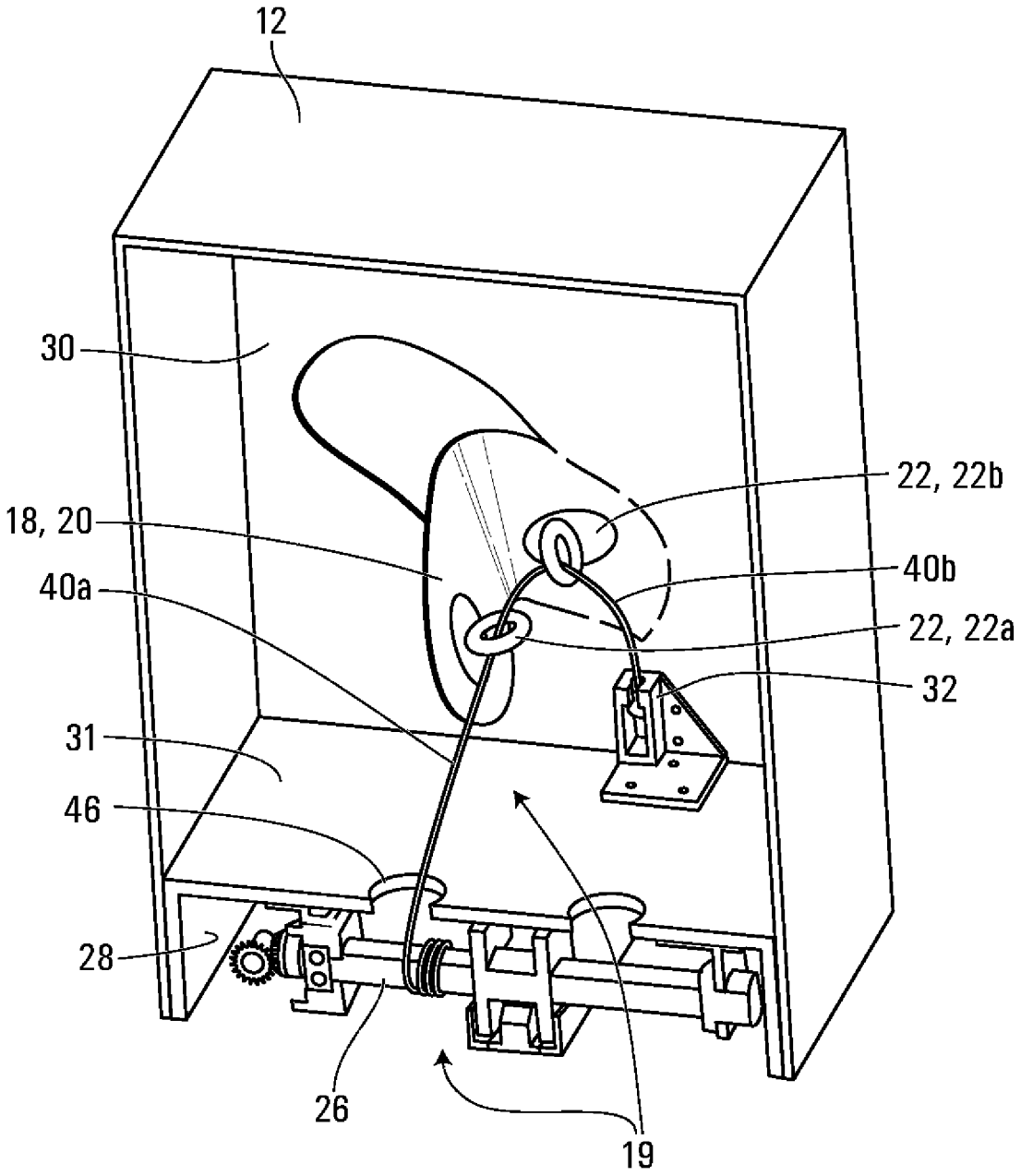
FIG. 3 is a perspective, sectional view of the toy assembly shown in FIG. 2, wherein the mechanism is in a partial state of actuation.

Once an eyelet 22 is pulled and has brought a portion of the set of at least one removable housing portion 18 with it, the tether 40 realigns to extend towards the next eyelet 22 in succession. Thus, once the eyelet 22*a* is pulled, the tether 40 realigns at a new angle towards the eyelet 22*b*. The toy assembly 10 is configured such that the new angle is suitable for ensuring that a sufficient first removal force F1 is applied to the subsequent eyelet 22*b*. It will be noted that, for a tether to be able to successfully apply a suitable removal force F1 to an eyelet 22, the tether 40 needs to be angled properly relative to the eyelet 22. For example, if the tether 40 were oriented in a direction where it extended through an eyelet 22 and did not touch the eyelet 22 or was substantially parallel to the axis of the eyelet 22, then the tether 40 will generate relatively little or no removal force on the eyelet 22. However, if the tether 40 is angled as shown in FIG. 2 or 3 relative to the eyelet 22, then the tether 40 will apply a more significant removal force on the eyelet 22.

FIG. 2 shows the tether 40 oriented so as to successfully apply the first removal force F1 on the first eyelet 22*a*. FIG. 3 shows the tether 40 oriented so as to successfully apply the first removal force F1 on the second (and, in the present example, final) eyelet 22*b*.

After applying the first removal force F1 to the final eyelet 22*b* from the first series of eyelets 22, the first tether 40 is angled such that rotation of the motor 24 to wind the first tether 40 on the at least one drum 26 pulls the free end 42 of the first tether 40 towards and through the second exit 36 of the first anchor slot 34, so as to remove the first tether 40 from the first anchor 32 (FIG. 5B).

Figure 4:
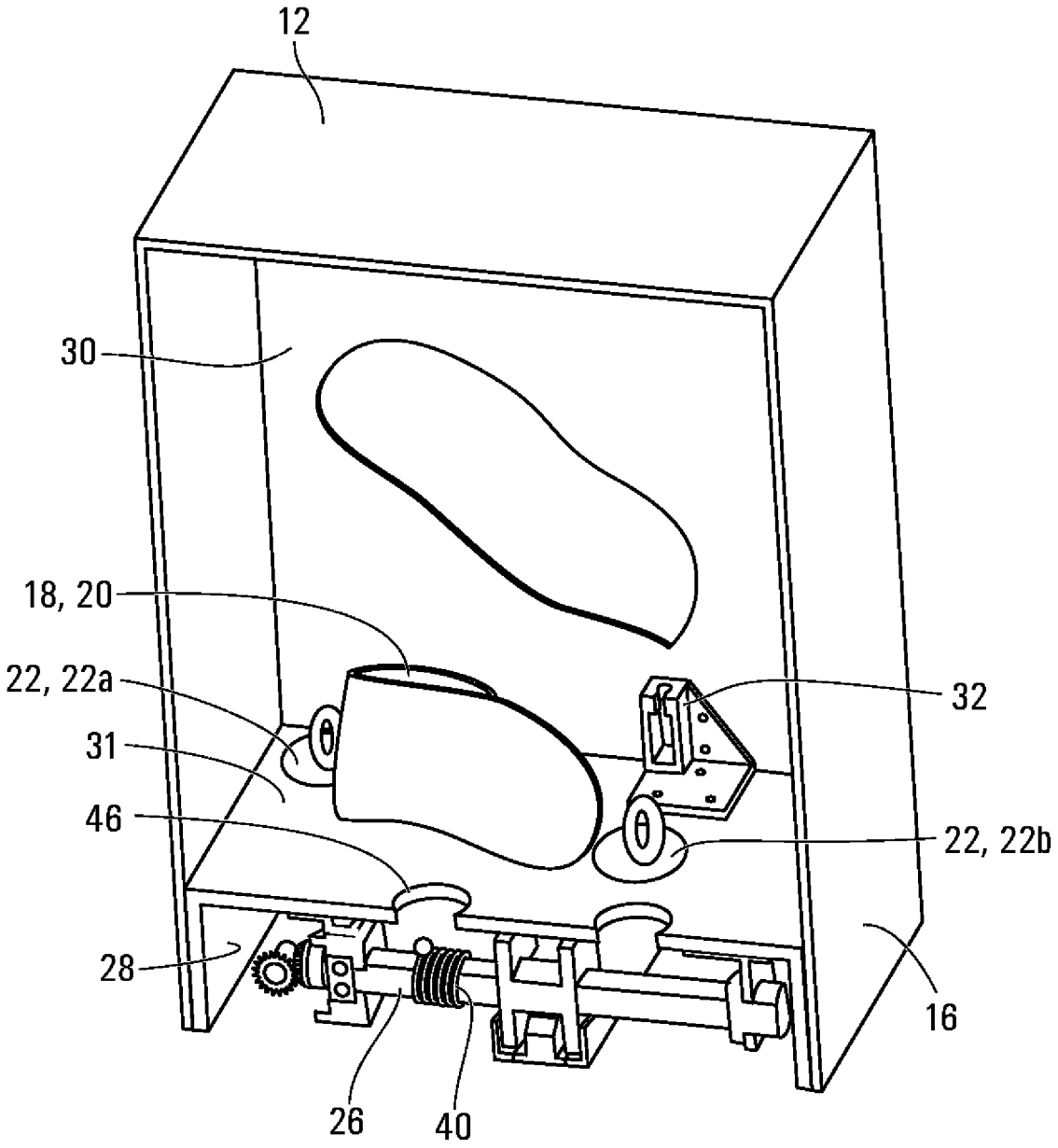
FIG. 4 is a perspective, sectional view of the toy assembly shown in FIG. 2, wherein the mechanism is in a fully actuated state.

Continued rotation of the motor 24 after the first tether 40 passes through the second exit 36 of the anchor slot 34, winds the first tether 40 on the drum 26 until the free end 42 of the first tether 40 passes through the eyelets 22 and leaves the main chamber 30 through the first tether pass-through aperture 31. As a result, the tether 40 itself is hidden from view by the user after it has been used to at least partially remove the set of at least one removable housing portion 18. FIG. 4 shows this state, which may be referred to as the actuated state. As will be understood, the eyelets 22 are preferably sized to permit the engagement member 44 on the tether 40 to pass therethrough.

The tethers 40 may be more broadly referred to as opening members that are positioned in the housing 12 and are positioned to open the housing 12 to expose the inner object 14. In the examples shown, this is done by winding the tethers 40 on one or more drums 26.

As can be seen in FIG. 4, once a user accesses the interior of the housing 12, it is not immediately obvious as to how the removable housing panel 20 was removed, increasing the appearance that the inner object was the cause, particularly in embodiments where the inner object is a character such as an animal.

Figure 9:
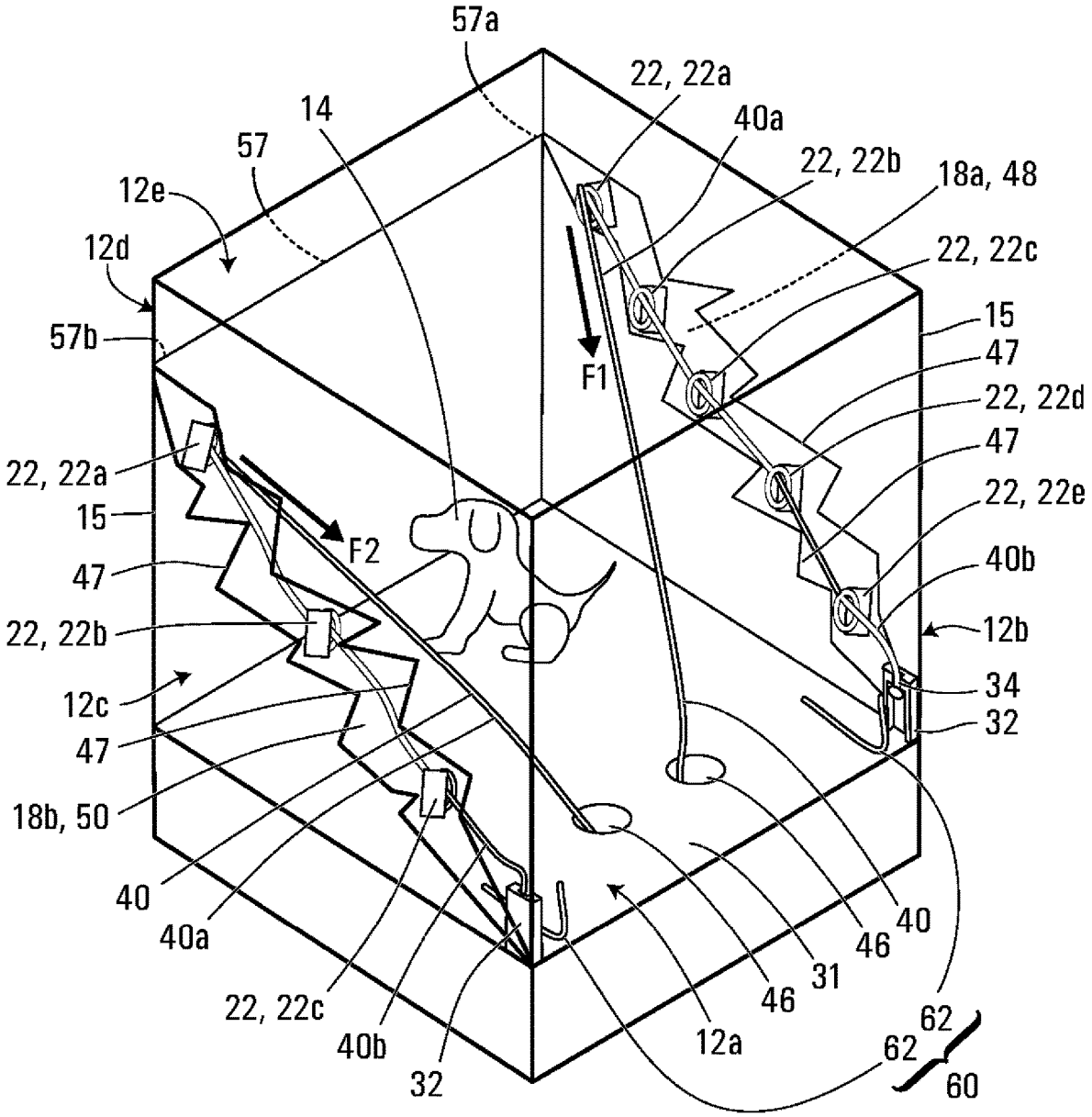
FIG. 9 is a perspective view of a toy assembly according to another non-limiting embodiment, wherein the mechanism is in an initial state.

FIG. 9 shows an alternative housing 12 with a first set of at least one removable housing portion 18*a* and a second set of at least one removable housing portion 18*b*. For simplicity and efficiency, the first and second sets of at least one removable housing portion 18*a* and 18*b* may be referred to as the first and second sets 18*a* and 18*b* respectively. In the present example, the first and second sets 18*a* and 18*b* each only include a single tear strip. The tear strip in the first set 18*a* is identified at 48. The tear strip in the second set 18*b* is identified at 50.

The first set of at least one removable housing portion 18*a* has a first series of eyelets mounted to it. In the present example the first series of eyelets 22 includes eyelets 22*a*, 22*b*, 22*c*, 22*d* and 22*e*. The second set 18*b* has a second series of eyelets mounted to it including eyelets 22*a*, 22*b* and 22*c*.

The eyelets 22 may be mounted in any suitable way to the first set of at least one removable housing portion 18*a*. For example, in FIG. 2, each eyelet 22 includes a base 37 and a loop structure 38 that is mounted to the base 22*a*, and the bottom side of the base 37 is joined to the inside surface (shown at 39) of the housing 12 (specifically of the removable housing panel 20) by an adhesive.

The toy assembly 10 shown in FIG. 9 has a first tether 40 that passes through the first series of eyelets 22, and a second tether 40 that passes through the second series of eyelets 22. In the example shown, the first tether 40 passes through a first tether pass-through aperture 46 in the platform 31, and the second tether 40 passes through a second tether pass-through aperture 46 in the platform 31, however it is alternatively possible for the two tethers 40 to pass through a single tether pass-through aperture. The housing 12 in FIG. 9 (and in FIG. 11) is shown as transparent so as to facilitate seeing the elements inside the housing 12.

Figure 10:
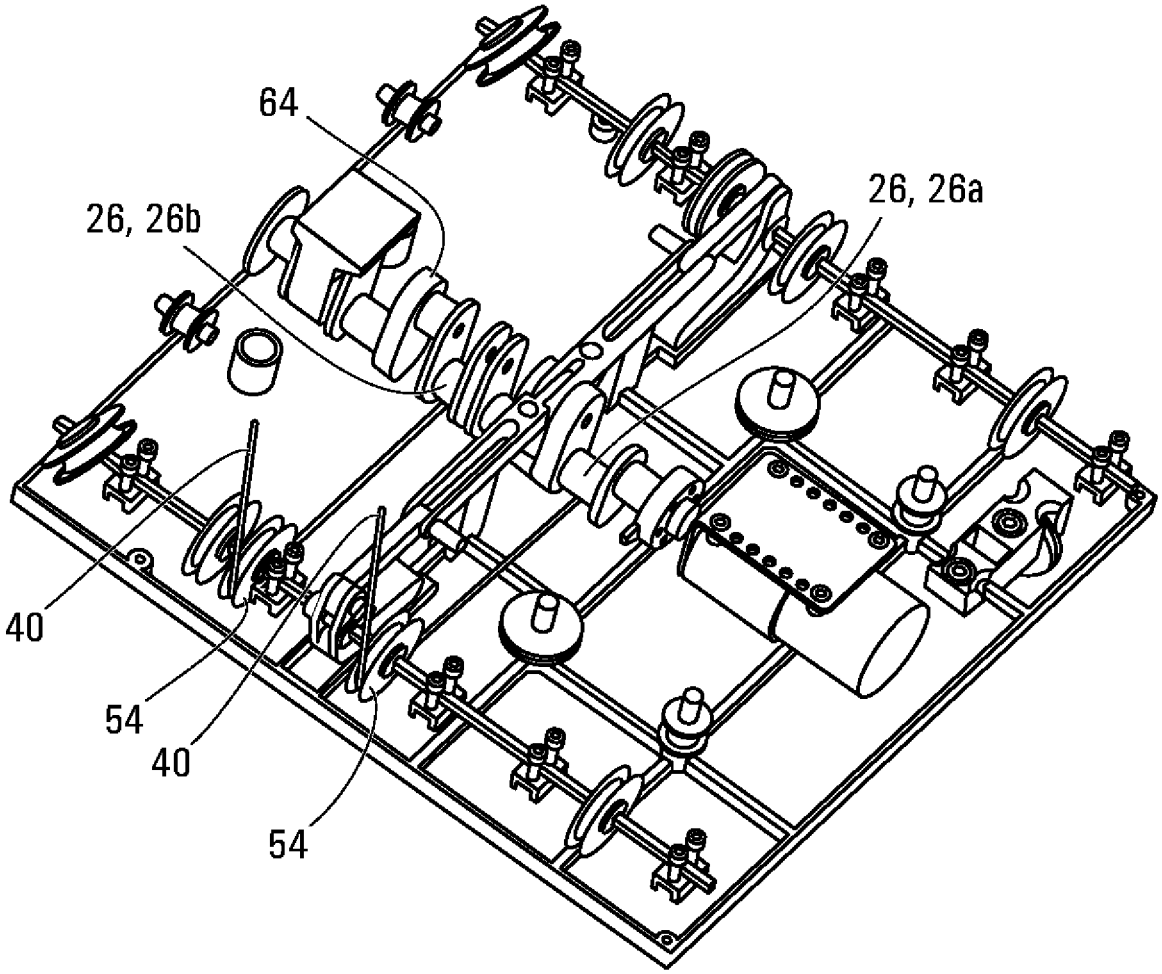
FIG. 10 is a perspective view of a drum chamber that can be used as part of the toy assembly shown in FIG. 9.

The tethers 40 wind onto at least one drum 26 (not shown in FIG. 9, but which may be as shown in FIG. 10. Pulleys shown at 54 may be used to guide the tethers 40 to the at least one drum 26 from the tether pass-through apertures 46 (not shown in FIG. 10, but shown in FIG. 9). In the example shown, the at least one drum 26 includes a first drum 26*a* (for the first tether 40) and a second drum 26*b* (for the second tether 40).

As with the arrangement shown in FIGS. 2-4, or each eyelet in succession in the first series of eyelets 22, a first segment 40*a* of the first tether 40 is angled relative to the eyelet 22 and a final segment 40*b* of the first tether 40 is angled relative to the first anchor slot 34 such that rotation of the motor 24 to wind the first tether 40 on the drum 26 pulls the free end 42 of the first tether 40 towards the first exit 35 (FIG. 5A) of the first anchor slot 34, and applies a first removal force F1 on each eyelet 22 in succession. The first removal force F1 is sufficiently strong to remove a portion of the first set of at least one removable housing portion 18*a* from the housing 12.

Once an eyelet 22 is pulled and has brought a portion of the first set of at least one removable housing portion 18*a* with it (i.e. a portion of the first tear strip 48), the tether 40 realigns to extend towards the next eyelet 22 in succession. Thus, once the eyelet 22*a* is pulled, the tether 40 realigns at a new angle towards the eyelet 22*b*. The toy assembly 10 is configured such that the new angle is suitable for ensuring that a sufficient first removal force F1 is applied to the subsequent eyelet 22*b*.

The second tether 40 and the second series of eyelets 22 may operate the same as the first tether 40 and the first series of eyelets 22, wherein the second tether 40 applies a second removal force F2 to the eyelets 22 in succession from the second series.

After applying the first removal force F1 to a final eyelet (eyelet 22*e*) from the first series of eyelets 22 and the second removal force F2 to a final eyelet (eyelet 22*c*) from the second series of eyelets 22, the first and second tethers 40 are angled as in FIG. 5B, such that rotation of the motor 24 to wind the first and second tethers on the at least one drum 26 pulls the free ends 42 of the first and second tethers 40 towards and through the second exits 36 of the first and second anchor slots 34 respectively, so as to remove the first and second tethers 40 from the first and second anchor 32. Further rotation of the motor 24 passes the free ends 42 of the tethers 40 through the eyelets 22 and finally through the tether pass-through apertures 46 and into the drum chamber 28 so that the tethers 40 leave the main chamber 30 entirely.

Figure 15:
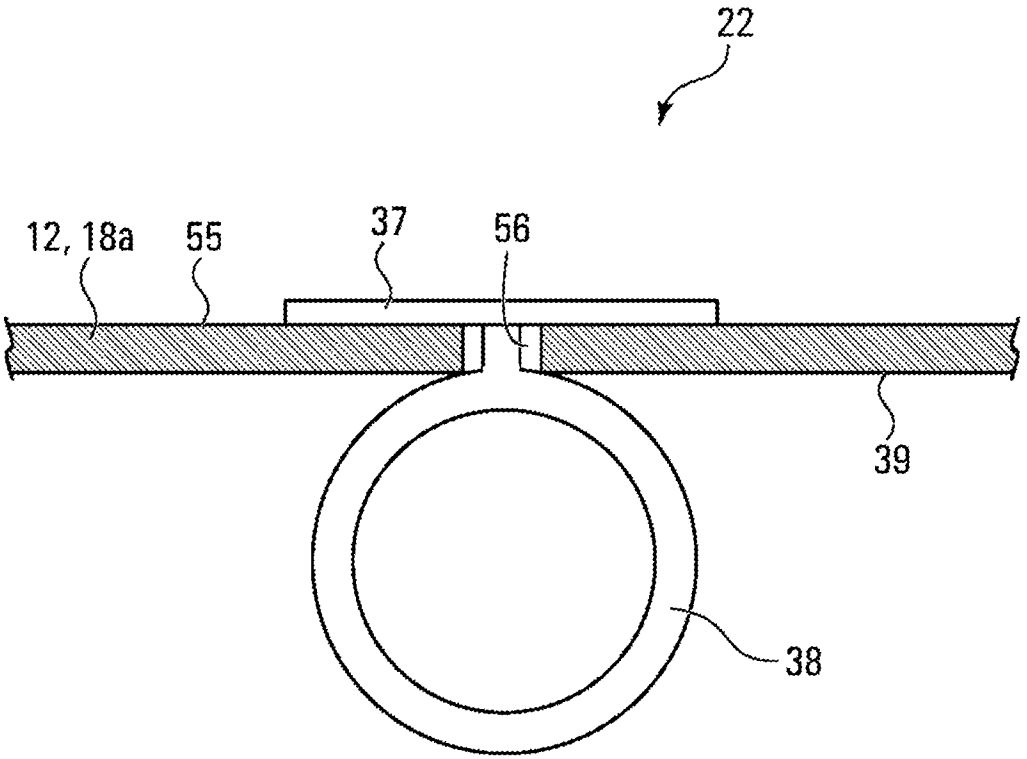
Figure 16:
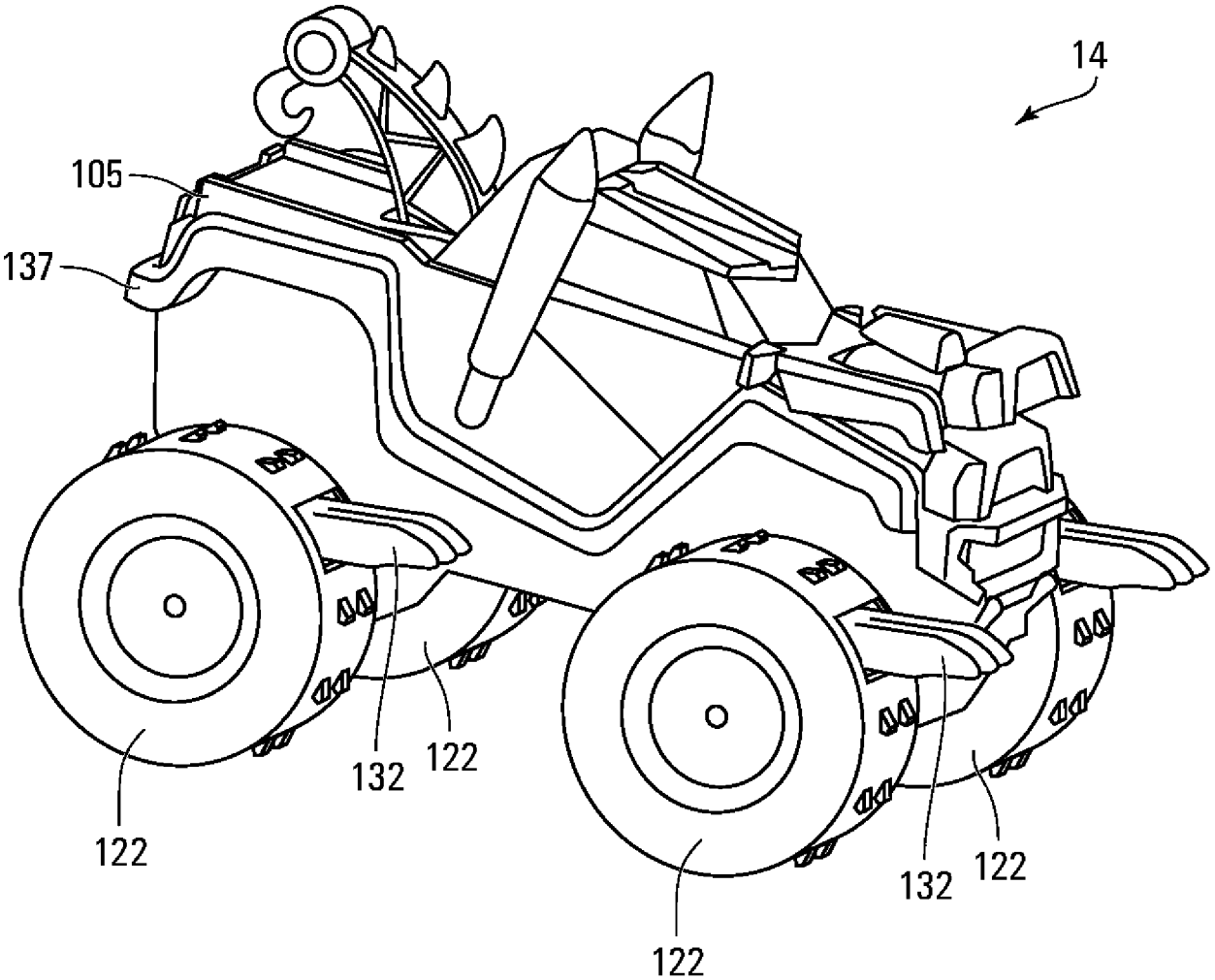
Figure 17:
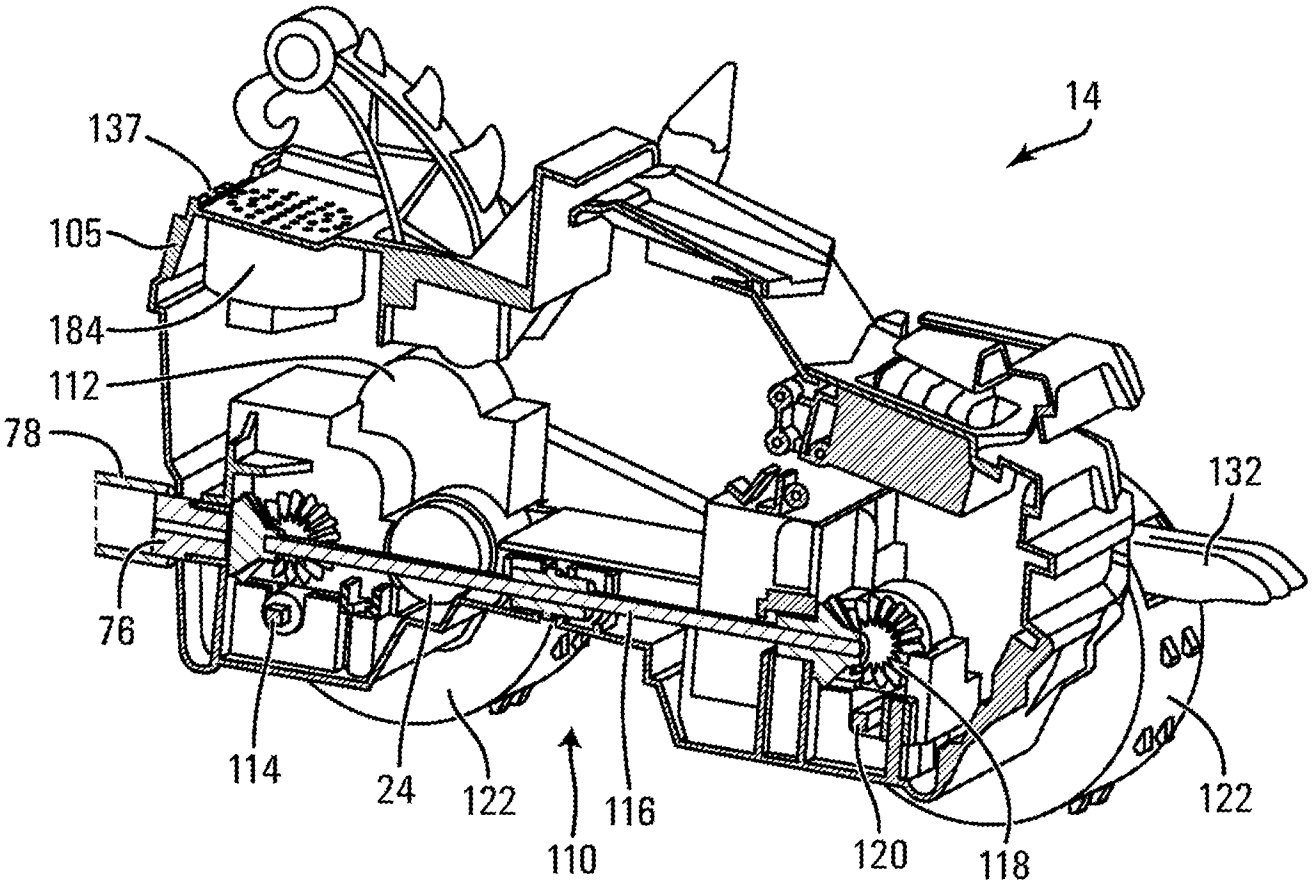
Figure 18:
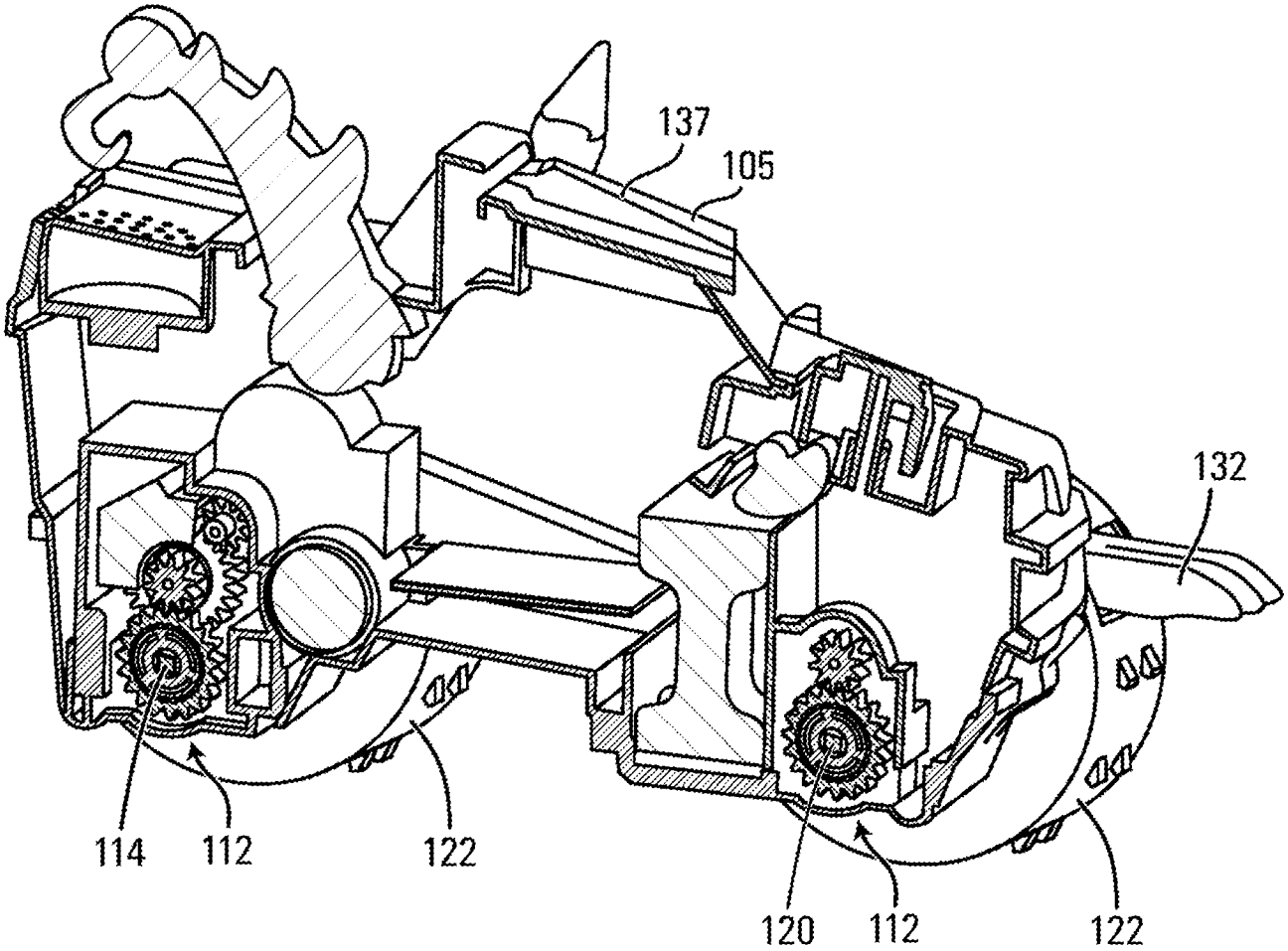

The eyelets 22 may alternatively be joined in any other suitable way to the housing 12 (i.e. to the first set 18*a*). For example, the use of adhesive may be difficult to apply reliably and is relatively labour intensive. Reference is made to FIG. 15, which shows an eyelet 20 that is mounted to the first set 18*a* in a different way. In the embodiment in FIG. 15, the base 37 is positioned against an exterior surface (shown at 55) of the housing 12, and the loop structure 38 extends from the base 37 through an eyelet pass-through aperture 56 in the housing 12 into the main chamber 30. The base 37 is larger than the eyelet pass-through aperture 56 so as to prevent the base 37 from being pulled through the eyelet pass-through aperture 56 during applying of the first removal force on said each eyelet 22 from the series of eyelets 22. To mount the eyelet 22 in this way, the loop structure 38 may be compressed resiliently in order to fit through the eyelet pass-through aperture 56, and then once through the eyelet pass-through aperture 56 the loop structure 38 can re-expand into the form shown in FIG. 15.

It will be noted that in the embodiment shown in FIG. 9 the fourth side 12*d* of the housing 12 is not connected to the top 12*e* of the housing. As can be seen the fourth side 12*d* is disconnected from the top 12*d* along a line of disconnection 57 having a first end 57*a* and a second end 57*b*. The first tear strip 48 (which may be referred to as a second-side tear strip 48 since it is on the second side 12*b* of the housing 12) extends between the first end 57*a* of the line of disconnection 57 and the first side 12*a*. The second tear strip 50 (which may be referred to as a third side tear strip 50) extends between the second end 57*b* of the line of disconnection 57 and the first side 12*a*.

Figure 11:
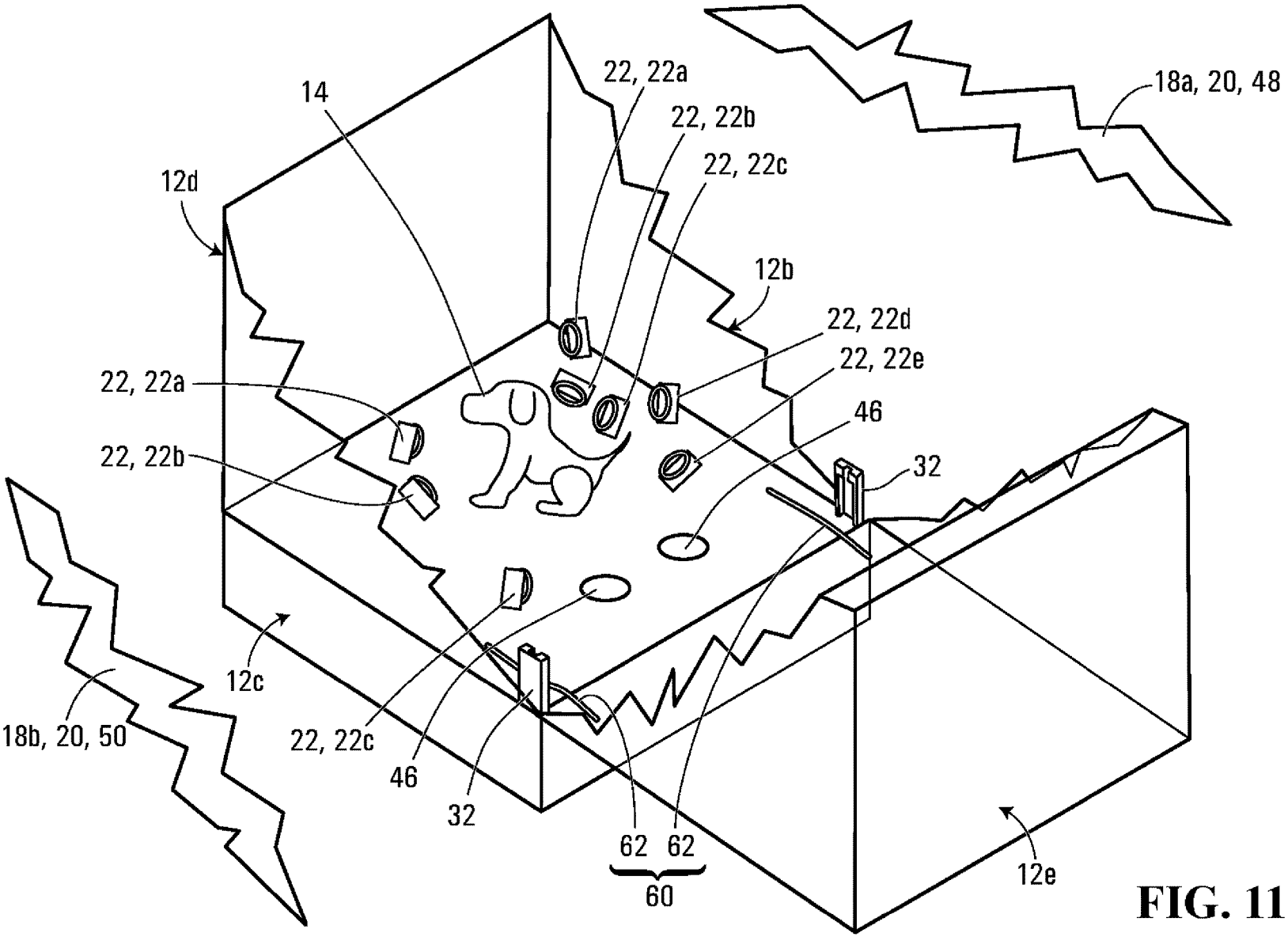
FIG. 11 is a perspective view of the toy assembly shown in FIG. 9, wherein the mechanism is in a fully actuated state.
Figure 13:
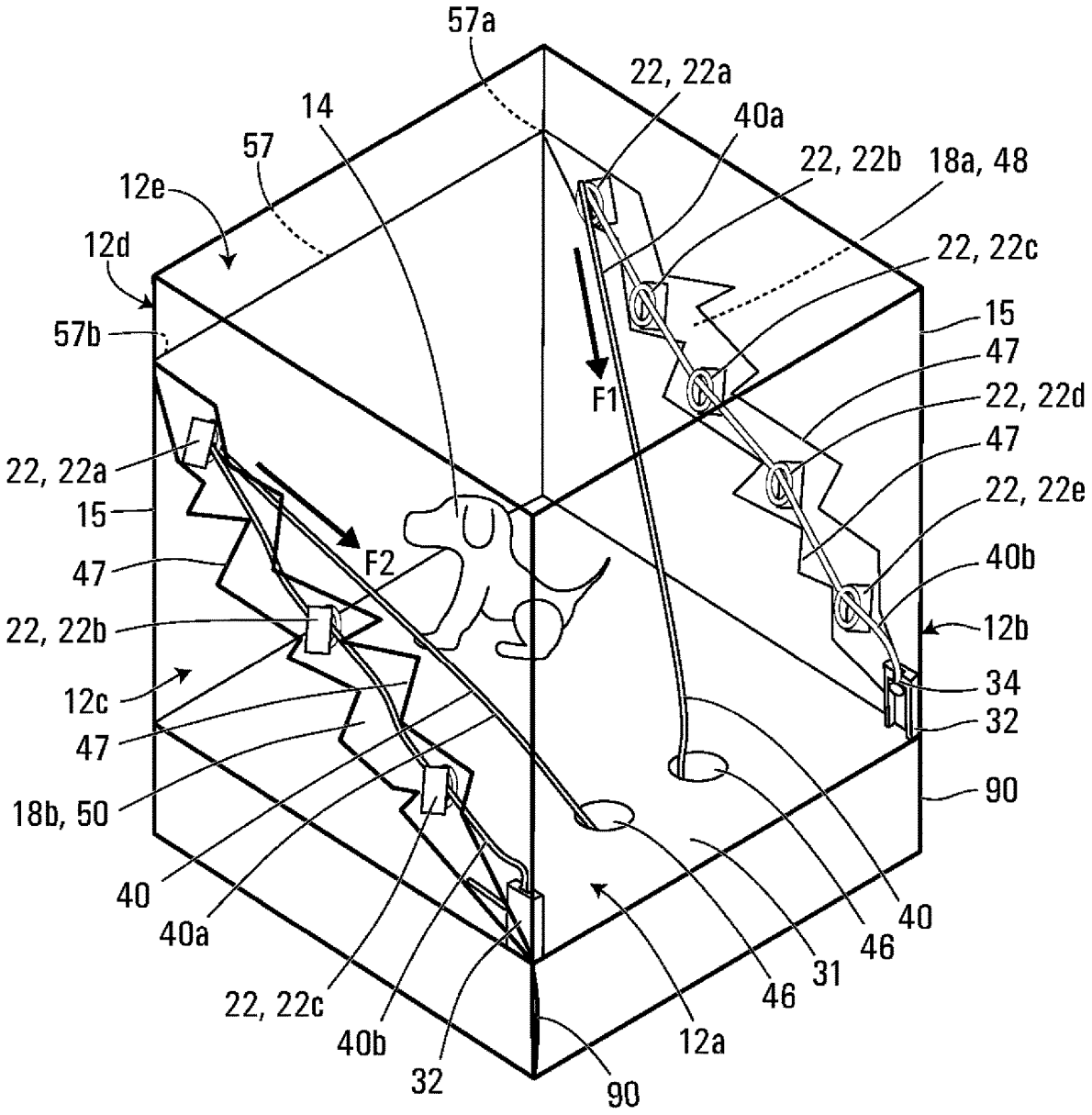

Once the second-side and third-side tear strips 48 and 50 have been at least partially removed from the housing 12, the first side 12*a* may be bent away from the main chamber 30 so as to expose the inner object 14 (FIG. 11). In some embodiments, the toy assembly 10 further comprises a first side drive structure 60 that is positioned to drive the first side 12*a* to bend away from the main chamber 30 so as to expose the inner object 14 once the first and second sets of at least one removable housing portion 18*a* and 18*b* have been at least partially removed from the housing 12. The first side drive structure 60 may be made up of at least one biasing member 62. In FIGS. 9 and 11, there are two biasing members 62 in the form of stiff wires that act as leaf springs. In an alternative embodiment shown in FIG. 13, there is a cut 90 provided between the first side 12*a* and each of the second and third sides 12*b* and 12*c* so that the entire first side 12*a* unfolds down when the tear strips 48 and 50 are removed sufficiently to reach the cut 90. The cut 90 in FIG. 13 extends from a bottom of the first side 12*a* to lower one of the tear lines 47 along the respective corner 15 for each of the tear strips 48 and 50.

In the example shown in FIG. 11, the tear strips 48 and 50 are shown completely removed from the housing 12 after the opening mechanism 19 has finished its operation.

While FIGS. 9 and 11 shows the toy assembly 10 employing the tethers 40 which pass through the eyelets 22, it is alternatively possible to employ tethers which pull the tear strips 48 and 50 off the housing 12 in other ways, while still providing the advantage of avoiding compromising the strength of the corners 15 of the housing 12. For example, tethers could be employed that are buried in the tear strips 48 and 50 on the second and third sides of the housing 12, wherein the motor 24 could pull the tethers which in turn pull the tear strips 48 and 50 from the housing 12. Thus it may be said that the first tether 40 is positioned to apply a first removal force F1 to the first tear strip, without limitation on whether or not it employs eyelets and that the second tether 40 is positioned to apply a second removal force F2 to the third-side tear strip without limitation on whether or not it employs eyelets. Furthermore it may be said that, rotation of the motor 24 to wind the first tether 40 on the at least one drum 26 and to wind the second tether 40 on the at least one drum 26 drives the first tether 40 to apply the first removal force F1 to the first tear strip 48 and drives the second tether 40 to apply the second removal force F2 to the second tear strip 50, so as to at least partially remove the first and second tear strips 48 and 50 from the housing 12.

FIG. 10 illustrates several ways of controlling the speed and torque applied in the operation of the tethers 40. As can be seen in FIG. 10, a drum shaft 64 is driven by the motor 24. The drum shaft 64 in FIG. 10 holds the drums 26*a* and 26*b* thereon (unlike the embodiment shown in FIG. 6 wherein the drum shaft itself constitutes the drum 26. Referring to FIG. 10, the drum shaft 64 holding the drums 26*a* and 26*b* is a crankshaft, which means that the central axis of each drum 26*a*, 26*b* orbits about a central crankshaft axis. As a result of the presence of the crankshaft 64, the torque (and therefore the force) applied to the tethers 40 (and therefore the removal forces applied by the tethers 40) varies based on the rotational position of the crankshaft 64. As well, the linear speed of the tethers 40 varies based on the rotational position of the crankshaft 64. Thus, the presence of the crankshaft 64 permits temporal variation in the torque and speed of the tethers 40 even if the motor 24 drives the crankshaft 64 at constant speed.

Additionally, it can be seen in FIG. 10 that the diameter of the drum 26*a* is larger than the diameter of the drum 26*b*. The difference in the diameters of the drums 26*a* and 26*b* affects the torque and linear speed of the tether 40 relative to one another. A larger diameter drum reduces the torque applied, but increases the speed of the tether 40, whereas a smaller diameter drum increases the torque applied to the tether but reduces its linear speed. Using such elements as a crankshaft and such elements as drums of different diameters, the toy assembly 10 can vary the amount of torque is applied to different tethers 40, can vary the speed of the tethers 40 temporally. Using drums of different diameters permits different tethers in the toy assembly to have different torque and different speeds relative to one another. These variations in the performance of the tethers 40 lends an air of realism to the operation of the toy assembly 10. In other words, it makes the operation of the toy assembly 10 appear more like the actions of a live animal or character inside the housing 12. Optionally, a controller (shown at 88) may be provided and a variable speed motor may be used as the motor 24, whereby the controller can vary the speed of the motor 24 so as to provide the desired variability in the operation of the tethers.

Figure 7:
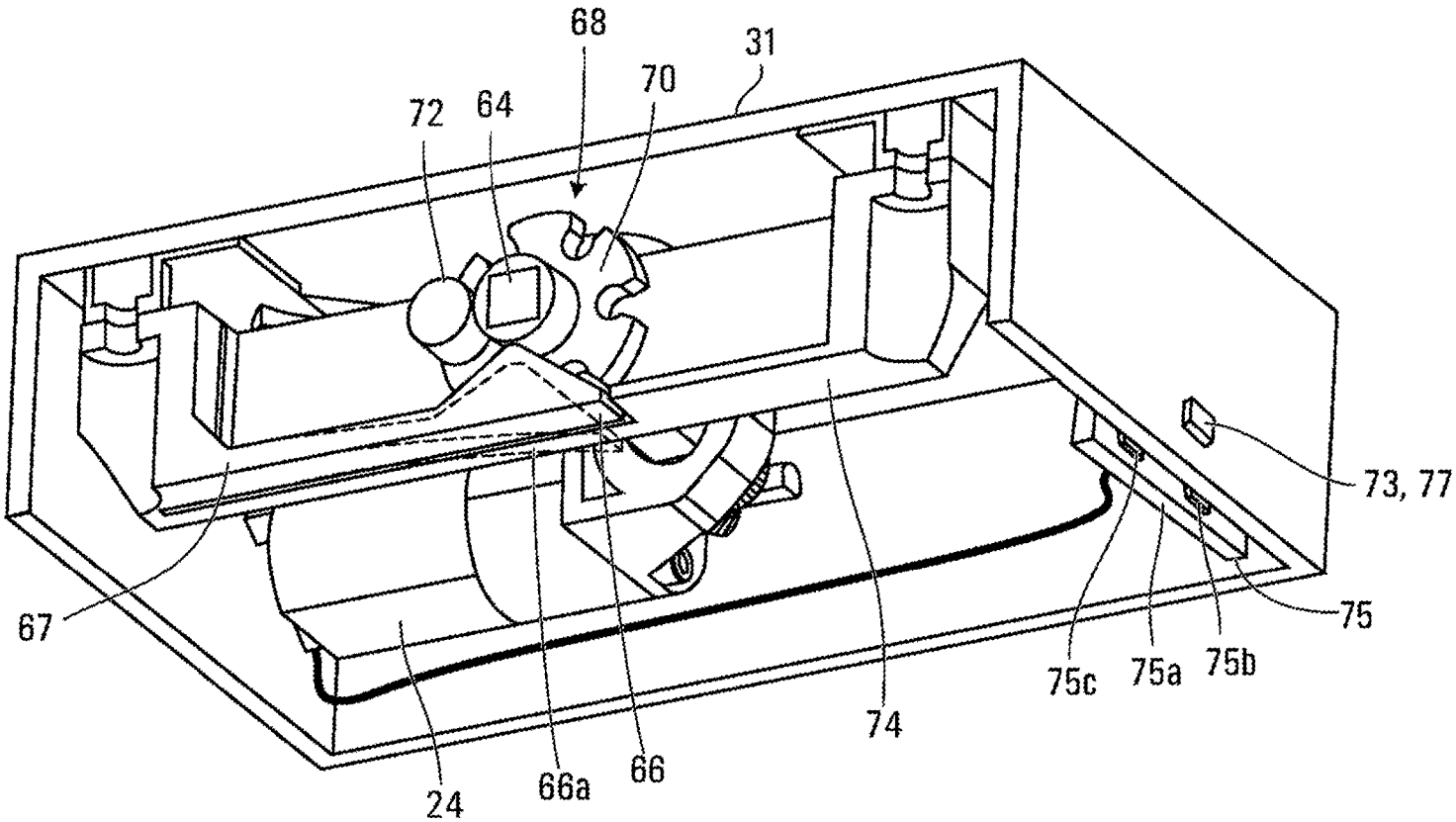
FIG. 7 is a perspective, sectional view of the drum chamber shown in FIG. 6.

Another structure that adds to the realism of the toy assembly 10 is shown in FIG. 7. The structure includes a foot 66 that is at the bottom of the housing 12 and a foot driver 68. The foot 66 is movably mounted to the housing 12. In the present example, the foot 66 is mounted to a structure element of the housing via a living hinge 67 that also acts as an integral, cantilevered leaf spring. As a result, the foot 66 is biased towards a home position in which the foot does not extend beyond the bottom of the housing 12. The foot driver 68 is driven by the motor 24 to drive the foot to extend beyond the bottom of the housing 12 at intervals to make the housing 12 appear as if it is being shaken by the character represented by the inner object therein. The foot driver 68 in the present example includes a foot driver wheel 70 that is mounted to the drum shaft 64 that is driven by the motor 24. The foot driver wheel 70 has one or more rollers 72 thereon which are spaced from one another, preferably in a non-uniform way (i.e. without exhibiting polar symmetry). When the rollers 72 engage the foot 66, they drive the foot 66 downward past the plane formed by the bottom 12*f* of the housing 12 (i.e. the plane of the bottom 12*f* of the housing 12 when the foot 66 is in the home position) so as to strike the surface on which the housing 12 is positioned, making the housing 12 jump slightly. The plane defined by the bottom side of the housing 12 may be represented by the surface 74. The bottom 12*f* of the housing 12 may be open as shown in the figures, or may be covered. Where it is covered, the bottom 12*f* may be covered fully, or partially. In the present example, the bottom 12*f* is covered partially.

Figure 6:
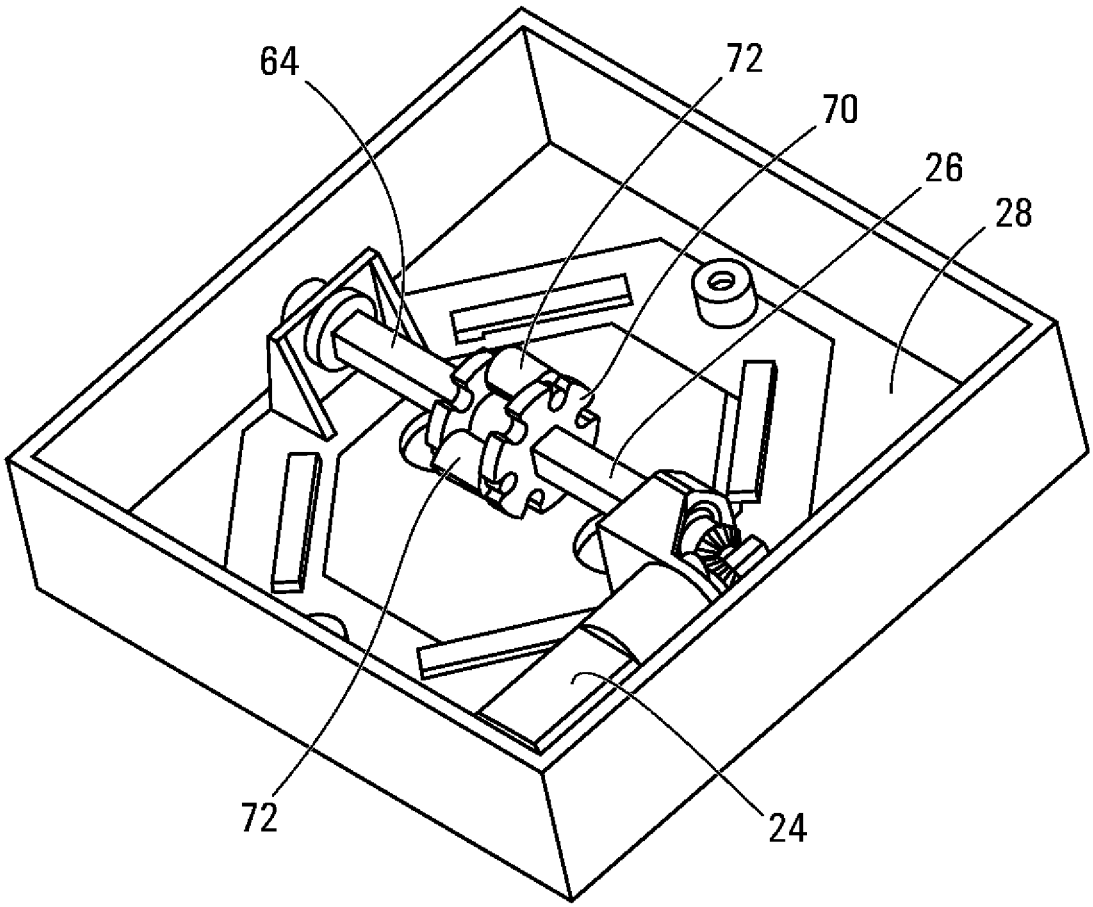
FIG. 6 is a perspective view of a drum chamber that is part of the housing shown in FIG. 2.

The position for the foot 66 may be referred to as the actuated position and is shown in dashed lines at 66*a* in FIG. 7. In the embodiment shown in FIG. 7, the foot driver wheel 70 contains only one roller 72, however it has positions for up to 6 rollers 72. In FIG. 6, the foot driver wheel 70 is shown holding two rollers 72.

In some embodiments, it is possible for the bottom side 12*f* to not have an aperture in it to permit the foot 66 to pass therethrough—it is possible that the foot 66 engages an interior face of the bottom 12*f* and pushes the bottom face 12*f* downward past the plane that was defined by the bottom 12*f* when the foot 66 was in the home position, so as to still cause the housing 12 to jump. As a result, rotation of the motor 24 and the drum shaft 64 repeatedly causes the rollers 72 to drive the foot 66 downwards to the actuated position to cause the housing 12 to jump, in a seemingly non-uniform (and therefore lifelike) way, and the foot 66 continues to be urged back towards its home position. If the toy assembly 10 is provided with a controller and a variable speed motor 24 then varying the speed of the motor 24 can further add to the variation in the jumping.

Figure 7A:
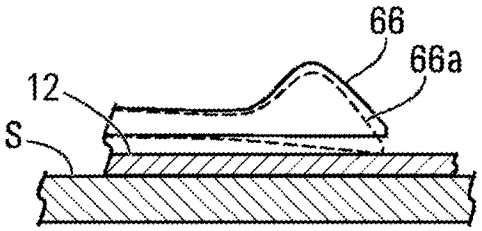
FIG. 7A is a magnified view of an impactor member in impact and non-impact positions.

The foot 66 constitutes an impactor member that is separate from the opening members (i.e. the tethers 40) and that is connected to the motor 24 to be driven by the motor 24 between an impact position (i.e. the actuated position 66*a* described above) in which the impactor member 66 impacts at least one of the housing 12 and the support surface on which the housing 12 is positioned to cause the housing 12 to move on the support surface and a non-impact position (referred to above as the home position) in which the impactor member 66 is spaced from the at least one of the housing 12 and the support surface. FIG. 7A shows the impactor member 66 in both the impact position and the non-impact position, in an embodiment in which the impactor member impacts the bottom 12*f* of the housing 12. FIG. 7A also shows the support surface identified at S on which the housing 12 is positioned. The support surface S may be, for example, a tabletop, a floor or any other suitable support surface.

Another way of adding variation to the operation of the tethers 40 may be by the amount of slack that is present in the tether 40. As a result of the amount of slack, the motor 24 can drive the tether 40 for some period of time until the slack is consumed at which point the removal force is generated by the tether. By varying how much slack is present in different tethers 40 (e.g. if a first tether 40 has less slack than a second tether 40), the first tether 40 can be caused to actuate at a different time than (e.g. before) the second tether 40.

Referring to FIG. 7, the toy assembly 10 may optionally have an input member 73 that is connected to a controller 75 that includes a printed circuit board 75*a* that has mounted on it a processor 75*b* and a memory 75*c*. The controller 75 is itself connected to the motor 24 in order to control operation of the motor 24 (e.g. to control current to the motor from a power source such as a battery or battery pack (not shown)). The input member 73 may be any suitable type of input member, such as a pushbutton 77, that is directly mounted on the printed circuit board 75*a*. The user of the toy assembly 10 may initiate the process of opening the housing 12 by the opening mechanism, by actuating the input member 72 (e.g. by pressing the pushbutton 77).

Methods of opening a toy assembly such as the toy assembly 10 are described below. In one example, the toy assembly includes a housing having a main housing portion, and a first set of at least one removable housing portion that is at least partially removable from the housing, a first series of eyelets mounted to the first set of at least one removable housing portion, an inner object inside the housing, a motor that drives at least one drum, a first anchor on the main housing portion, wherein the first anchor has a first anchor slot having a first exit and a second exit, a first tether having a free end which has an engagement member that is unable to pass through the first exit of the first anchor slot but can pass through the second exit of the first anchor slot, wherein the first tether passes sequentially through each of the series of eyelets between the at least one drum and the first anchor, wherein, in an initial state the engagement member is positioned in the first anchor slot at the first exit of the first anchor slot. The method comprises:

driving the motor to wind the first tether on the at least one drum and to wind the second tether on the at least one drum, wherein, during said driving, for each eyelet in succession in the first series of eyelets, a first segment of the first tether is angled relative to the eyelet and a final segment of the first tether is angled relative to the first anchor slot such that the first tether pulls the free end of the first tether towards the first exit of the first anchor slot, and applies a first removal force on each eyelet in succession in the first series of eyelets, wherein the first removal force is sufficiently strong to remove a portion of the first set of at least one removable housing portion from the housing; and after applying the first removal force to a final eyelet from the first series of eyelets, driving the motor to wind the first tether on the at least one drum with the first tether angled so as to pull the free end of the first tether towards and through the second exit of the first anchor slot, so as to remove the first tether from the first anchor.

Figure 8:
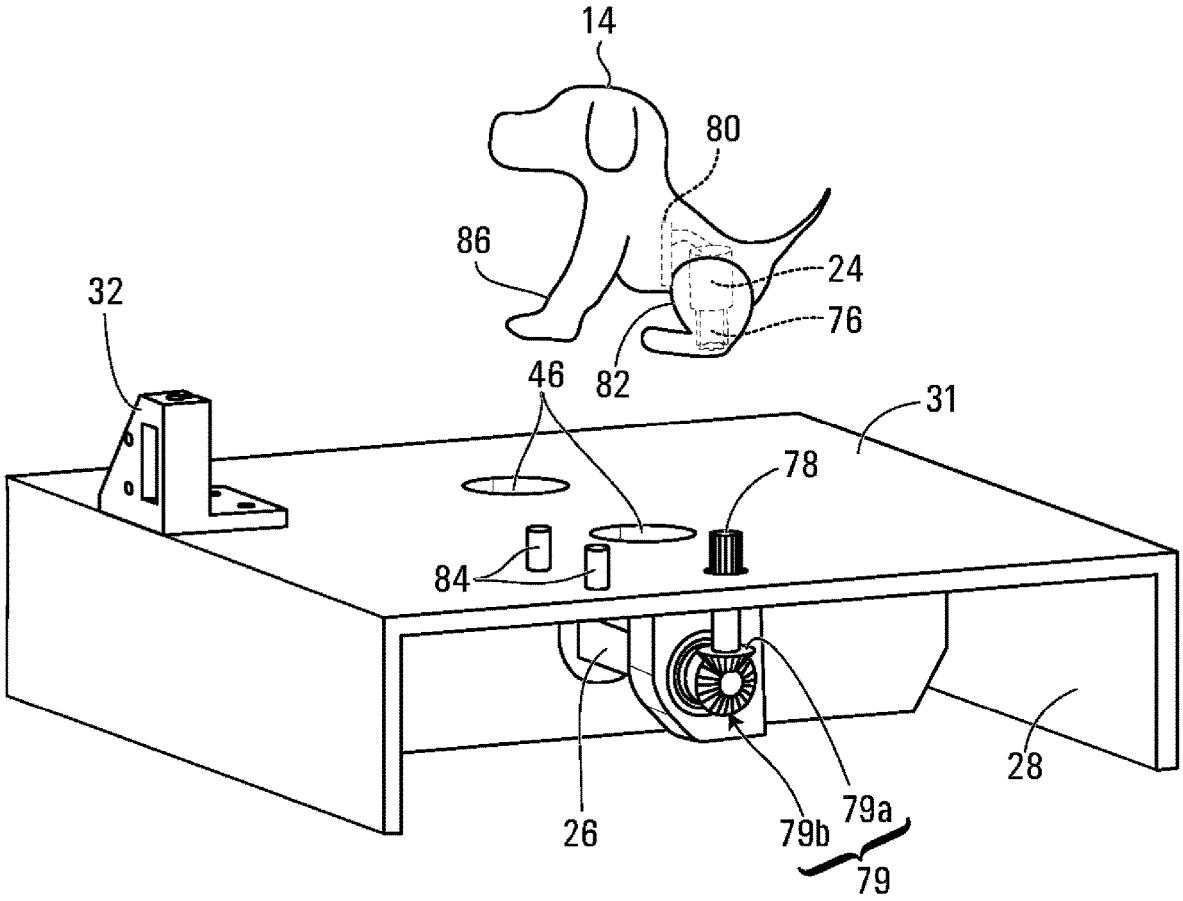
FIG. 8 is a perspective exploded view of a toy assembly according to another non-limiting embodiment.

In another example, the toy assembly includes a housing having a main housing portion, and a first tear strip that is at least partially removable from the housing, an inner object inside the housing, a motor that drives at least one drum, a first tether positioned to apply a first removal force to the first tear strip, wherein the housing has a first side, a second side, and a third side, wherein the second side and the third side are each adjacent the first side, wherein, for each side of the first, second and third sides, the housing further includes a side corner connecting said each side with any of the first, second, and third sides that are adjacent to said each side, and wherein the housing includes a top, wherein the first tear strip is a second-side tear strip extending along the second side between the first side and an opposing end of the second side, wherein the third side has a third-side tear strip extending between the first side and an opposing end of the third side, wherein the toy assembly further comprises a second tether positioned to apply a second removal force to the third-side tear strip. The method comprises:

rotating the motor to wind the first tether on the at least one drum and to wind the second tether on the at least one drum, so as to drive the first tether to apply the first removal force to the first tear strip and drives the second tether to apply the second removal force to the second tear strip, so as to at least partially remove the first and second tear strips from the housing; and driving the first side to bend away from the main chamber so as to expose the inner object once the second-side and third-side tear strips have been at least partially removed from the housing. The tear strips (e.g. the tear strips 48 and 50) are defined by tear lines in the sides, wherein the tear lines do not extend across any of the corners FIG. 8 shows a variation of the toy assembly 10, in which the motor 24 is provided in the inner object 14, and is connectable to drive the drum shaft 64 by any suitable means. For example, the motor 24 may drive an inner object output shaft 76, which in the present example is a hollow, splined shaft. The inner object output shaft 76 may receive a housing input shaft 78 that is itself splined and which extends up through the platform 31 (or more broadly referred to as the divider) from the drum chamber 28 into the main chamber 30. The housing input shaft 78 therefore transfers power from the motor 24 into the drum shaft 64 and into the drum 26 via a right angle gear arrangement 79 (in this example, made up of two bevel gears 79*a* and 79*b*), and may therefore be said to be operatively connected to the opening members (i.e. the tethers 40), which is at least partially outside of the inner member 14 (and is entirely outside of the inner member 14 in the embodiment shown in FIG. 8). The controller 75 is provided in the inner object 14 shown in FIG. 8, and controls the operation of the motor 24 when driving the tethers 40.

In the present example, the inner object output shaft 76 is directly mounted to the output shaft of the motor 24. In order to ensure that rotation of the inner object output shaft 76 does not result in counterrotation of the motor's stator and the inner object 14 to which the stator is mounted, the inner object 14 may be braced when in the housing 12 when driving the drum shaft 64. For example, two bracing posts 84 may be provided, which may sit immediately on either side of the inner object's front legs. One of the front legs of the inner object is shown at 86 in FIG. 8.

As a result of providing the motor 24 in the inner object 14, the motor 24 can be used to drive movable elements (e.g. the rear leg of the dog represented by the inner object 14, shown at 82) of the inner object 14 after the inner object 14 is removed from the housing 12, thereby enhancing the play value of the inner object 14. Furthermore, the housing 12 may then be discarded after it has been opened to reveal the inner object 14, with little wastage having been generated, since the housing sides may be made from cardboard or the like, and the drum shaft 64, pulleys 54 if provided may be made from plastic, and the structural components can be made from plastic. Glue and/or small screws may be used where appropriate to connect parts together. As a result, most or all of the housing 12 may be recyclable and may be relatively inexpensive, so that the cost of the toy assembly 10 is largely present in the inner object 14 itself, which continues to have play value after the opening operation has been carried out.

Figure 14:
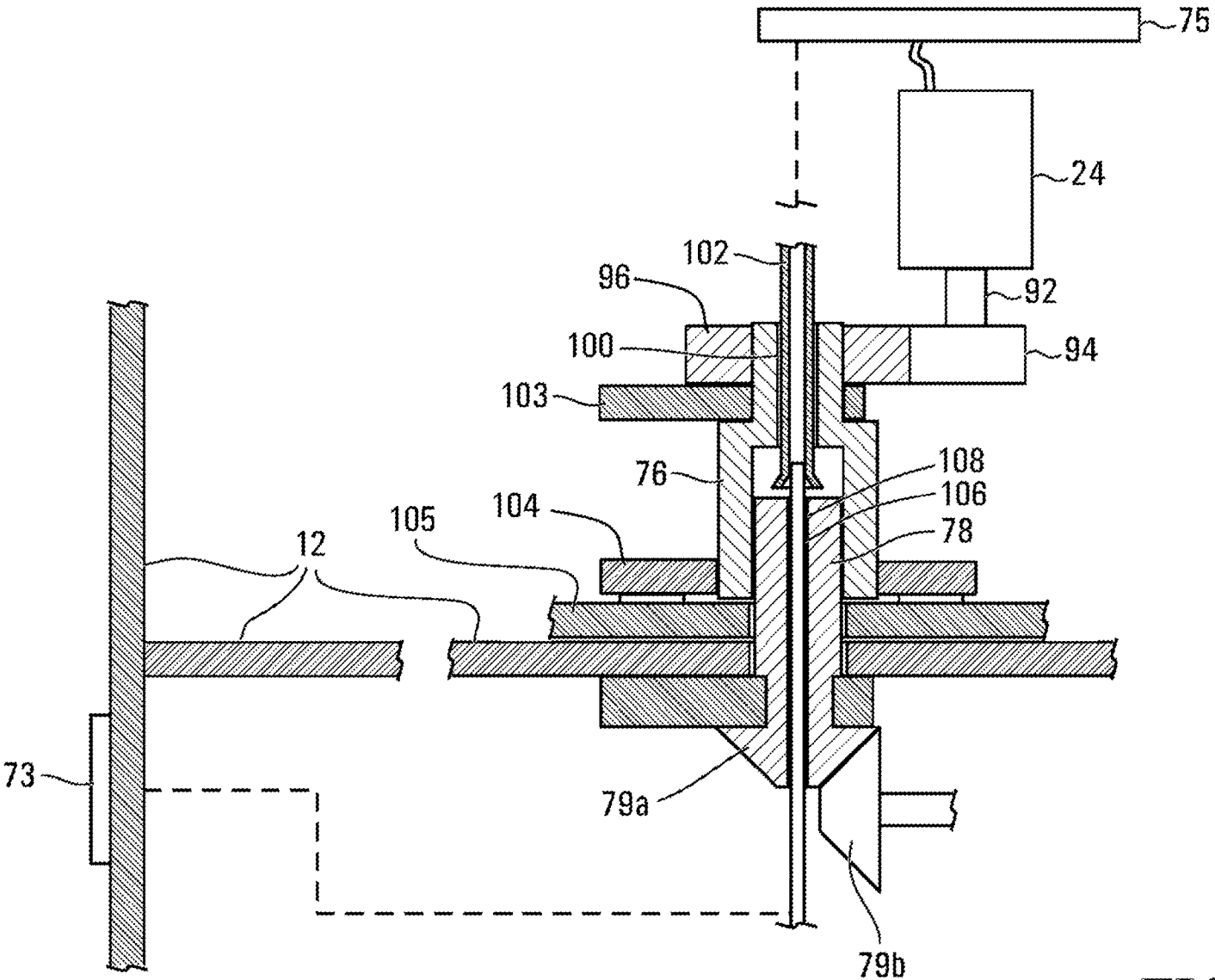

FIG. 14 shows an embodiment that is similar to that shown in FIG. 8, but which provides an electrical connection between the inner object 14 and the housing 12. A user can initiate the opening process by the opening mechanism by actuating the input member 73, via the electrical connection. In the embodiment shown in FIG. 14, the inner object 14 has the motor 24, and the controller 75, and the power source for providing power to the motor 24. The motor 24 has a motor shaft 92 on which there is a motor gear 94. The motor gear 96 is engaged with a driven gear 98, which is mounted onto the inner object output shaft 76 which is again a hollow splined shaft. The inner object output shaft 76 has a pass-through aperture 100, through which an inner object electrical terminal 102 passes. In the present example, the inner object electrical terminal 102 is a female terminal provided on a female terminal projection, however it is alternatively possible for it to be a male terminal. The inner object electrical terminal 102 is part of the inner object 14 and is connected to the controller 75 so as to transmit signals thereto. The inner object output shaft 76 receives the housing input shaft 78. Put another way, the housing input shaft 78 removably extends into the inner object 14 to engage the inner object output shaft 76 such that rotation of the motor 24 drives the housing input shaft 78, which in turn drives the opening members (i.e. the tethers 40) to open the housing 12. Suitable support elements, shown at 103 and 104 support the inner object output shaft 76 for rotation within the inner object 14. The inner object housing is shown in FIG. 14 at 105. It will be understood that the inner object housing 105 is not to be confused with the housing 12, which may also be referred to as the toy assembly housing 12.

A housing electrical terminal 106 in the housing 12 is in electrical communication with the inner object electrical terminal 102, so as to communicate actuation of the housing input member 73 to the controller 75 in the inner object 14. The controller 75 is connected to the motor 24 to control operation of the motor 24 based on actuation of the housing input member 73. In the embodiment shown in FIG. 14, the housing electrical terminal 106 is a male electrical terminal (e.g. a pin) although in an alternative embodiment, it could be a female electrical terminal. In the embodiment shown in FIG. 14, the housing electrical terminal 104 passes through a central passage 108 in the housing input shaft 78 and into engagement with the inner object electrical terminal 102. The housing electrical terminal 106 and the inner object electrical terminal 102 may be two-wire terminals, or terminals having any other suitable number of wires leading thereto.

As a result of the above-described structure, the user can initiate opening of the housing 12 by the opening mechanism 19, by actuating the housing input member 73, which sends a signal to the controller 75 to operate the motor 24 accordingly.

In other embodiments, the housing input member 73 may be electrically connected to the controller 75 in any other suitable way, such as, for example, by means of conductive pads on the platform 31 on which the inner object 14 sits, with conductive pads on the inner object 14 itself.

Instead of providing the drum 26 in a drum chamber 28 that is part of the housing 12, the drum 26 and the drum shaft 64 could be provided directly in the inner object 14. In such an embodiment, the tethers 40 would pass into the inner object 14 through one or more apertures in the inner object 14. As a result, there would be no need transfer rotary power from the motor out of the inner object and into a housing input shaft 78 in the housing 12. Accordingly, it will be understood that such elements as the housing input shaft 78, and the right-angle gear arrangement 79 and other related elements could be eliminated. It will also be understood that it may still be possible in such an embodiment for the tethers 40 to pass underneath the platform 31 on which the inner object 14 sits through advantageously positioned apertures so that the angles of each tether 40 is arranged as needed for its operation. The tethers 40 could then pass up through one or more final apertures in the platform 31 proximate to the inner object 14 before passing into the inner object 14 for winding on the drum 26 that is contained therein in such an embodiment.

The anchors 32 have been shown to be provided on the main housing portion 16 in the embodiments shown in the figures. However, the anchors 32 could alternatively be provided on the inner object 14 itself, particularly in embodiments in which the drum 26 is provided in the inner object 14.

Reference is made to FIGS. 16-26, which show another embodiment of the inner object 14. In this embodiment, the inner object 14 is a vehicle, which is identified at 109. The motor 24 (FIG. 17) is mounted inside the vehicle 109, and is connected to drive the opening members (i.e. the tethers 40) to open the housing 12, and is also connected to an inner object travel mechanism 110 that is part of the inner object 14. The inner object travel mechanism 110 shown in FIGS. 17 and 18 includes a gearbox shown at 112 that drives a rear axle 114, and a drive shaft 116 that drives a set of gears 118 that is used to drive a front axle 120. The rear axle 114 has first and second drive wheels 122 thereon, while the front axle 120 has third and fourth drive wheels 122 thereon. It will be understood that it is alternatively possible to refer to the drive wheels 122 on the front axle 120 as the first and second drive wheels and the drive wheels 122 on the rear axle 114 as the third and fourth drive wheels 122. While four drive wheels 122 are shown and described, it will be noted that there could be any suitable number of drive wheels 122 such as one or more drive wheels 122. In other words, there is at least one drive wheel 122.

Figure 19A:
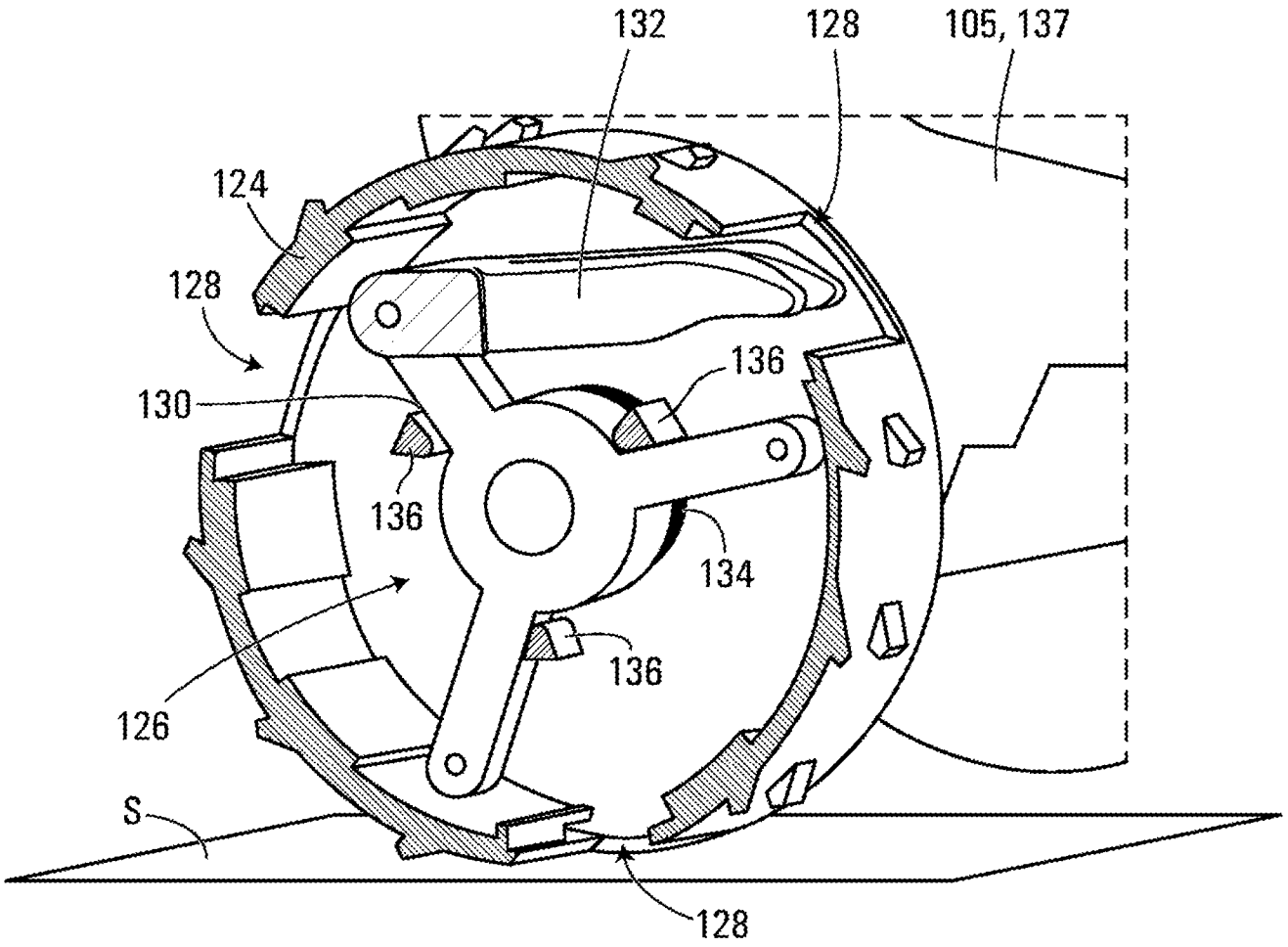
Figure 19B:
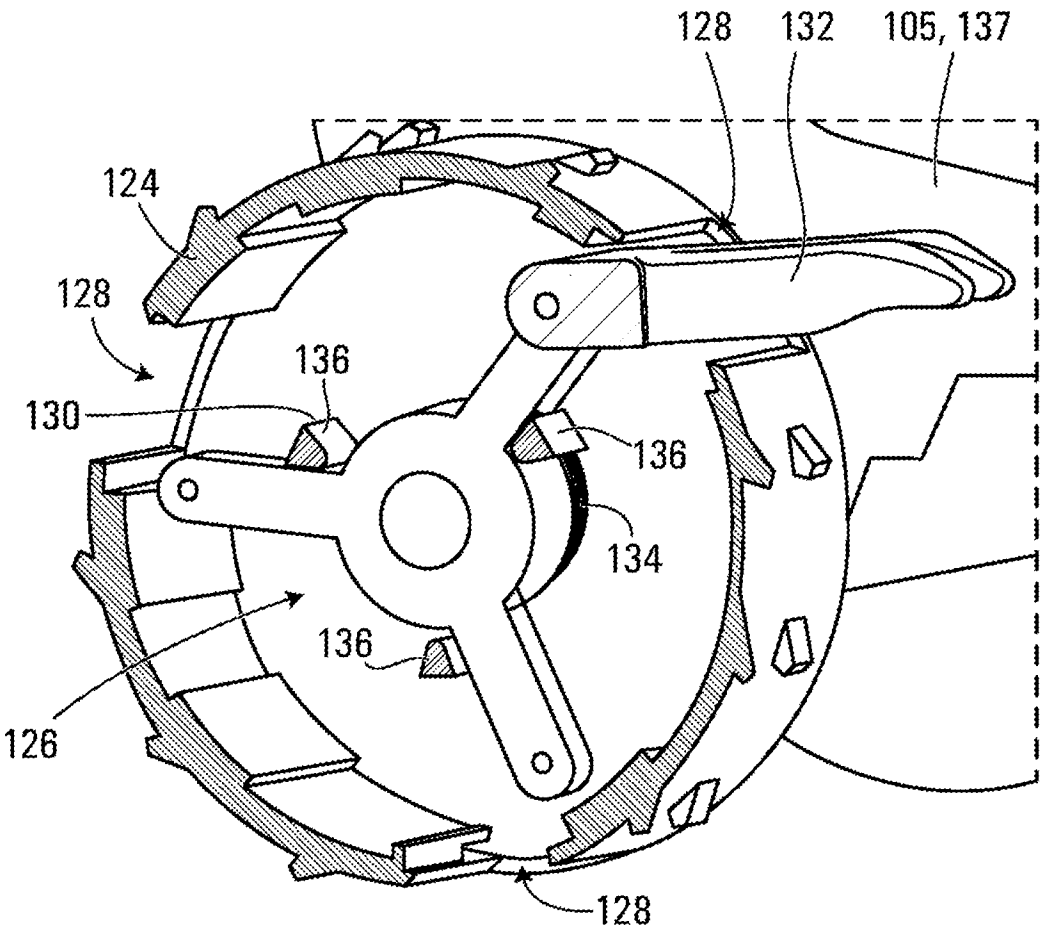

In the embodiment shown in FIGS. 19A and 19B, the at least one drive wheel 122 includes a wheel shell 124 defining a wheel shell chamber 126 and having at least one wheel shell aperture 128. In the embodiment shown in FIGS. 19A and 19B, there are three wheel shell apertures 128. A projection frame 130 is positioned in the wheel shell chamber 126 and holds at least one wheel projection 132. In the embodiment shown in FIGS. 16-26, the projection frame 130 holds three wheel projections 132, though in FIGS. 19A and 19B only one wheel projection 132 shown, and other two are not shown. The connection between the projection frame 130 and each of the wheel projections may be pivotal connections via pins that extend through the projection frame 130 and each of the wheel projections 130. A wheel shell biasing member 134 connects the projection frame 130 to the wheel shell 124 and urges the projection frame 130 towards a retraction position (i.e. the position shown in FIG. 19A) in which the projection frame 130 retains the at least one wheel projection 132 in the wheel shell chamber 126. The projection frame 130 is rotatable by the motor 24, such that during rotation of the projection frame 130 by the motor 24, torque is transferred to the wheel shell 124 through the wheel shell biasing member 134. During use on a support surface S, if a resistive torque applied by the support surface S against the wheel shell 124 exceeds a selected torque, relative movement between the projection frame 130 and the wheel shell 124 occurs, which causes the projection frame 130 to drive the at least one wheel projection 132 to extend from the wheel shell 124 through the at least one wheel shell aperture 128. This relative movement causes flexure of the wheel shell biasing member 134. The position shown in FIG. 19B may be referred to as an extended position. In the embodiment shown, the wheel shell biasing member 134 is a torsion spring however it could be any other suitable type of biasing member.

Figure 21:
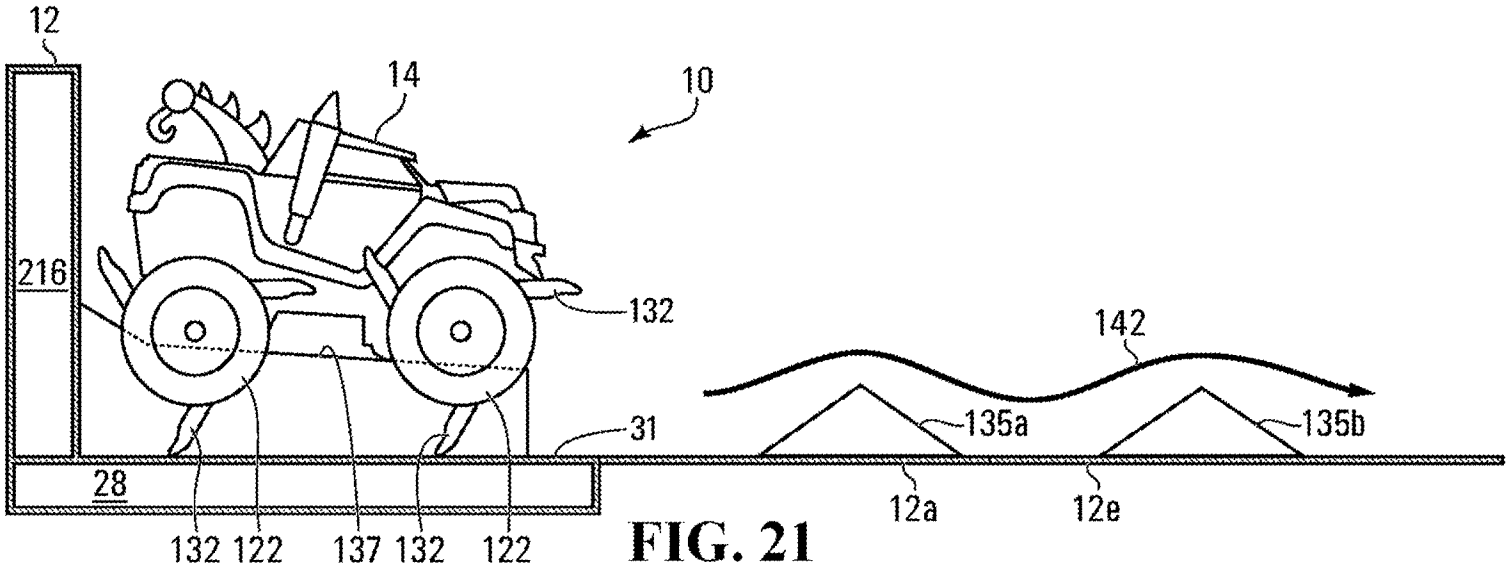

Such a selected resistive torque may occur when the vehicle 109 is moving over an obstacle, such as one of the hills shown at 135*a* and 135*b* in FIG. 21. While the at least one wheel projection 132 is extended, it may provide the vehicle 109 with sufficient capability to overcome the obstacle.

Limit members 136 are provided on the wheel shell 124 to limit the range of relative movement between the projection frame 130 and the wheel shell 124 so as to keep the projection frame 130 in a range of movement that permits the wheel projections 132 to pass through the wheel shell apertures 128.

Once the resistive torque drops back below the selected torque, the at least one wheel projection 132 retracts as the wheel shell 124 and the projection frame 130 return to their home position relative to one another, as shown in FIG. 19A.

Optionally, the at least one drive wheel 122 includes a lock (not shown) to hold the projection frame 130 and the wheel projections 132 in the extended position. Such a lock may simply be provided by a pin in the wheel shell 124 that aligns with a hole in the projection frame 130. The user can manually turn the wheel shell 124 while pressing the pin in the wheel shell 124 until the wheel shell 124 is rotated sufficiently that the pin finds the hole in the projection frame 130. At this point the wheel projections 132 remain in the extended position.

Figure 20:
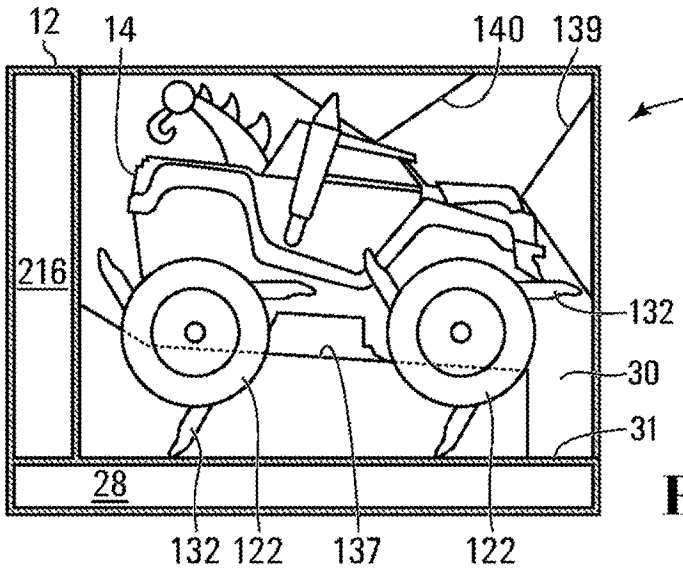

While the vehicle 109 is in a storage position (as shown in FIG. 20), it may rest on an inner object support 137 that supports a body (shown at 138) of the inner object 14, such that the drive wheels 122 engage the floor of the main chamber 30 with less force than if the inner object support 136 were not present. In the present embodiment, the floor of the main chamber 30 is provided by the platform 31, and the engagement of the drive wheels 122 with the platform 31 is through the wheel projections 132, which may optionally be held in the extended positions by the aforementioned lock. The housing 12 further includes two inner object abutment surfaces 139 and 140 that abut the inner object 14 when the housing is closed, so as to inhibit the inner object 14 from moving forward while it is in the storage position. Rotation of the motor 24 drives the opening mechanism (to be described further below) to open the housing 12, and optionally to form a departure path 142 (FIG. 21) out of the housing 12. In the example shown, the departure path 142 includes hills 135*a* and 135*b*, which are formed by the two inner object abutment surfaces 139 and 140, respectively. When the housing 12 is open (as shown in FIG. 21), the inner object abutment surfaces 139 and 140 are separated from the inner object 14 so as to permit the inner object 14 to travel away from the storage position, and optionally out of the housing 12 on the optional departure path 142.

Figure 22:
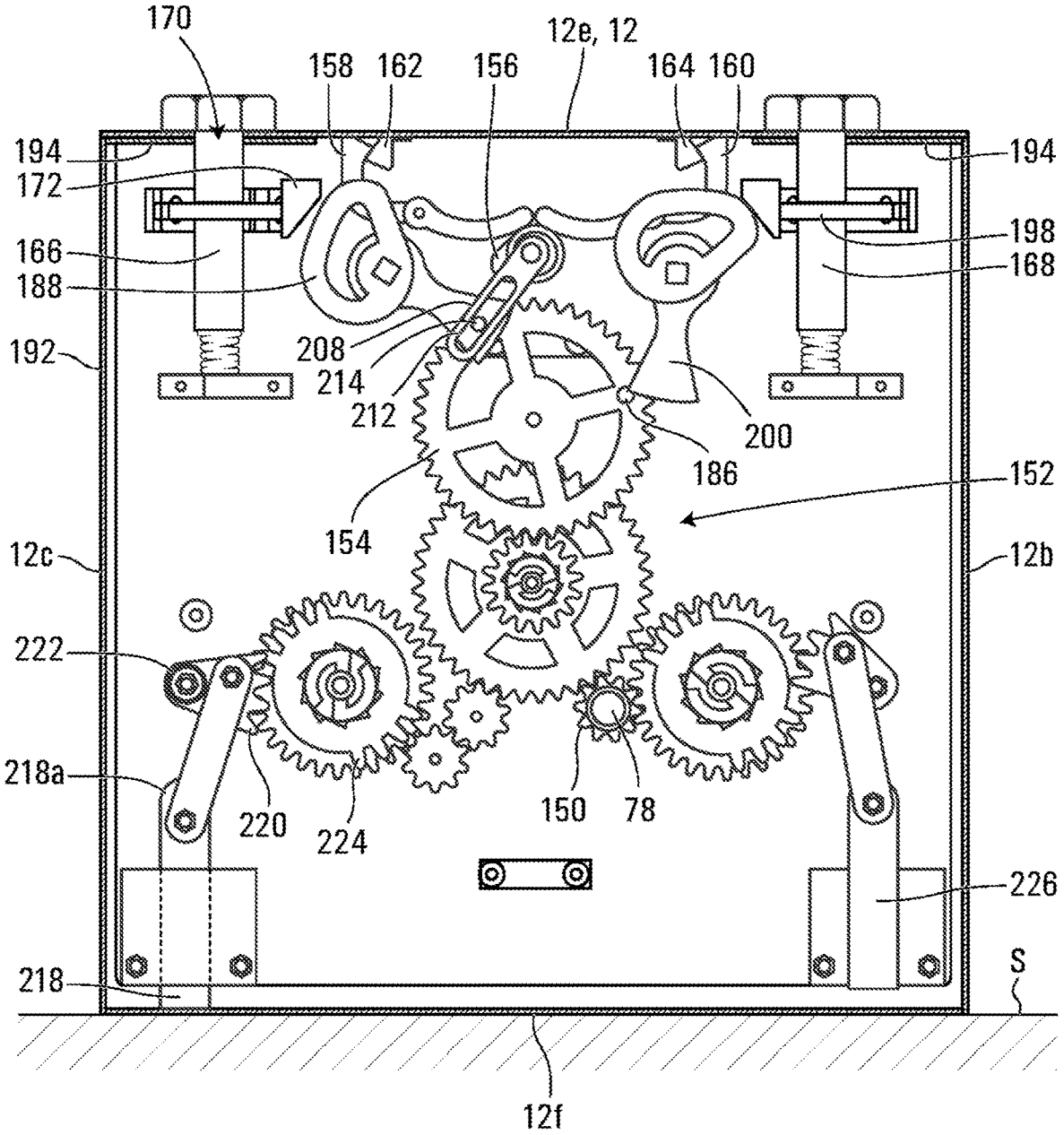

The toy assembly 10 shown in FIGS. 16-26 includes an opening mechanism 19 that is different than the opening mechanisms shown in FIG. 2-15. The opening mechanism 19 for the toy assembly 10 shown in FIGS. 16-26 is shown in FIGS. 22-25. The opening mechanism 19 may operate by drawing power from the motor 24 in the vehicle 109. Specifically, the opening mechanism 19 has a housing input shaft 78 that is, in the present case, a hollow splined shaft, which receives the inner object output shaft 76 that is in the inner object 14 (shown in FIG. 17), and which a splined shaft that is driven by the motor 24. Referring to FIG. 22, the housing input shaft 78 is coaxial with a main drive gear 150. The main drive gear 150 is connected through a drive arrangement 152 (which includes, in the present example, a plurality of driven gears), to a final gear 154, which controls the operation of a latch cam 156. The latch cam 156 in turn controls a first latch 158. In the present embodiment, a second latch 160 is provided and is also controlled by the latch cam 156. The latches 158 and 160 engage housing locking elements 162 and 164 on the top 12*e* of the housing 12 and thus control the opening of the housing 12. Optionally, first and second fasteners shown at 166 and 168 also control the opening of the top 12*e* of the housing 12, and are also controlled by the operation of the motor 24 through the opening mechanism 19 (and specifically by the rotation of the final gear 154).

The operation of the opening mechanism 19 with respect to the first fastener 166 will be described first. Initially, when the housing 12 is closed, the fastener 166 extends into a receiving aperture 170, and is held by a fastener locking member 172 in the receiving aperture 170. The fastener 166 is visible from outside the housing 12 and its removal from the receiving aperture 170 can form part of the play pattern for the toy assembly 10. A fastener driver 178 urges the fastener 166 towards discharge from the receiving aperture 170. The fastener driver 178 may be any suitable type of biasing member, such as a compression spring, which is shown schematically in the view shown in FIGS. 23 and 24.

The fastener locking member 172 has a locking projection 174 thereon, and a fastener blocking projection 175 thereon. When the fastener locking member 172 is in a fastener locking position (FIG. 23), the locking projection 174 is received in any one of a plurality of first fastener locking teeth 176 in the fastener 166 (shown in FIG. 23) to hold the fastener 166 in the receiving aperture 170. The fastener locking member 172 is movable between the fastener locking position shown in FIG. 23, and a fastener release position shown in FIG. 24. In the fastener release position, the fastener locking member 172 permits the fastener driver 178 to drive the fastener 166 towards discharge from the receiving aperture 170. However, when the fastener locking member 172 is in the fastener release position, the blocking projection 175 is positioned to engage one of a plurality of fastener blocking teeth 180 on the fastener 166 that are separate from the plurality of fastener locking notches 176. As a result, when the fastener driver 178 drives the fastener 166 towards discharge from the receiving aperture 170, one of the fastener blocking teeth 180 will engage the blocking projection 175 to limit how far the fastener 166 is driven. Then, when the fastener locking member 172 is returned to the fastener locking position, the locking projection 174 moves to a position to engage a subsequent one of the fastener locking teeth 176 as the blocking projection 175 disengages from the fastener blocking tooth 180 that it was engaged with. The fastener locking member 172 may be biased towards the fastener locking position by a locking member biasing member 182, which may be, for example, a compression spring, which is represented schematically in FIGS. 23 and 24. Repeated movement of the fastener locking member 172 between the fastener locking position and the fastener release position eventually brings the fastener 166 to the position in which the last fastener blocking tooth 180 is engaged with the blocking projection 175. At this point, when the fastener locking member 172 is moved such that the blocking projection 175 is disengaged from the fastener blocking tooth 180, the fastener driver 178 drives the fastener 166 to leave the receiving aperture 170. Optionally, if the force applied by the fastener driver 178 is sufficiently strong, the fastener driver 178 will drive the fastener 166 out from the receiving aperture 170 with sufficient force to drive the fastener 166 into the air outside of the housing 12. When this occurs, particularly if it is coupled with sounds emitted by the controller 75 through a speaker (shown at 184 in FIG. 17) and/or other movement in the toy assembly 10, can make it appear to the user that the inner object 14 is alive and has pushed the fastener 166 out, thereby adding to the play pattern for the toy assembly 10.

Figure 23:
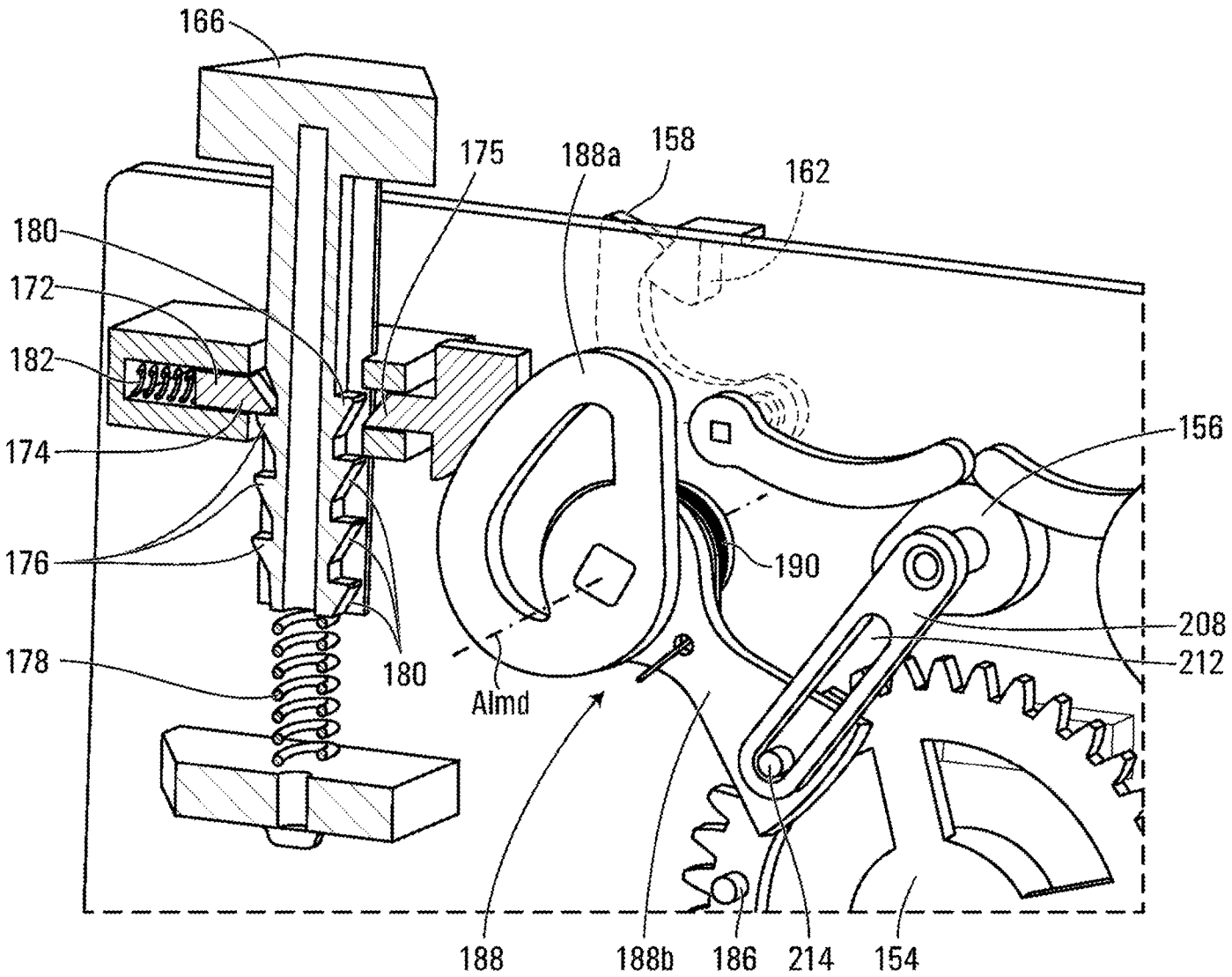
Figure 24:
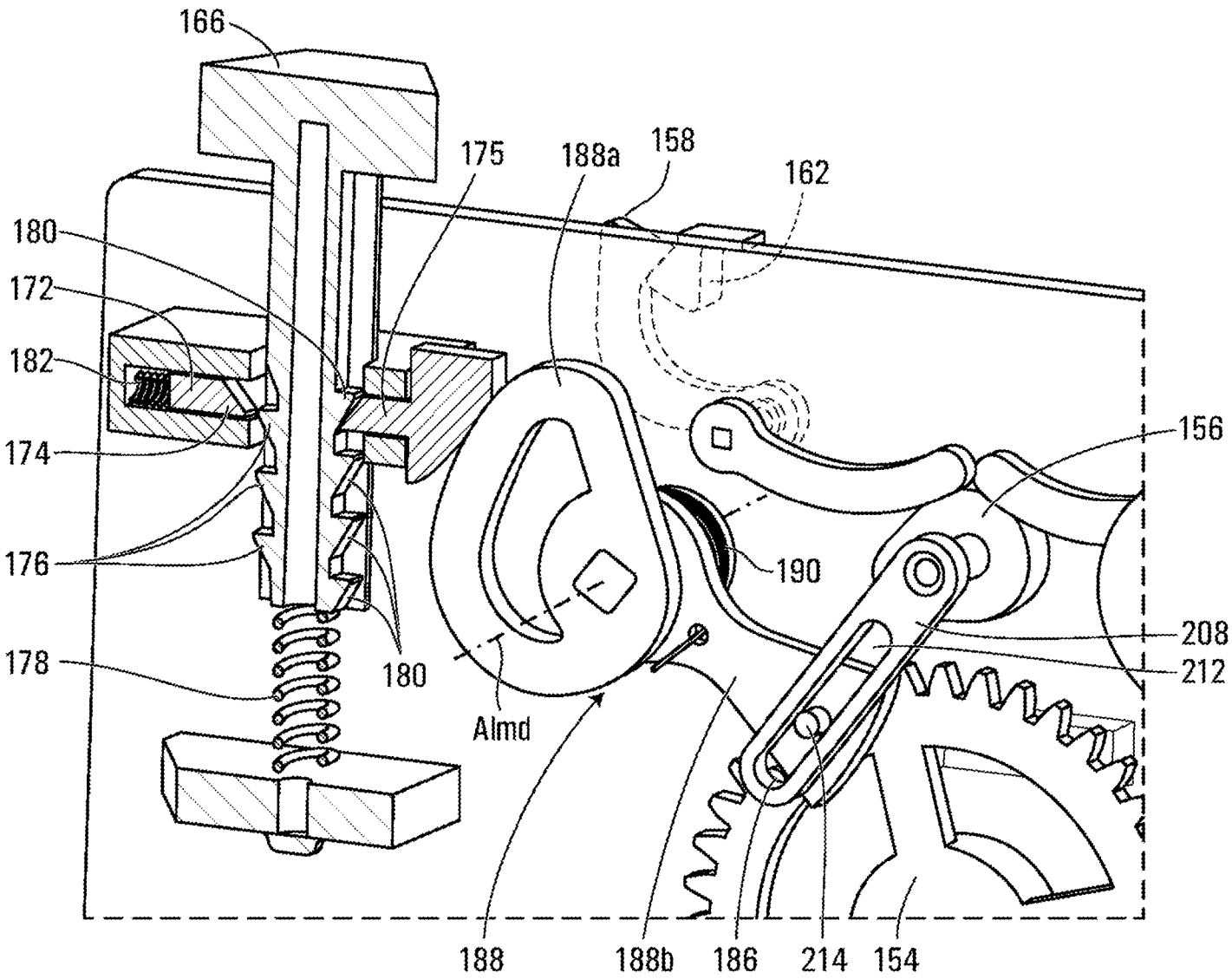
Figure 25:
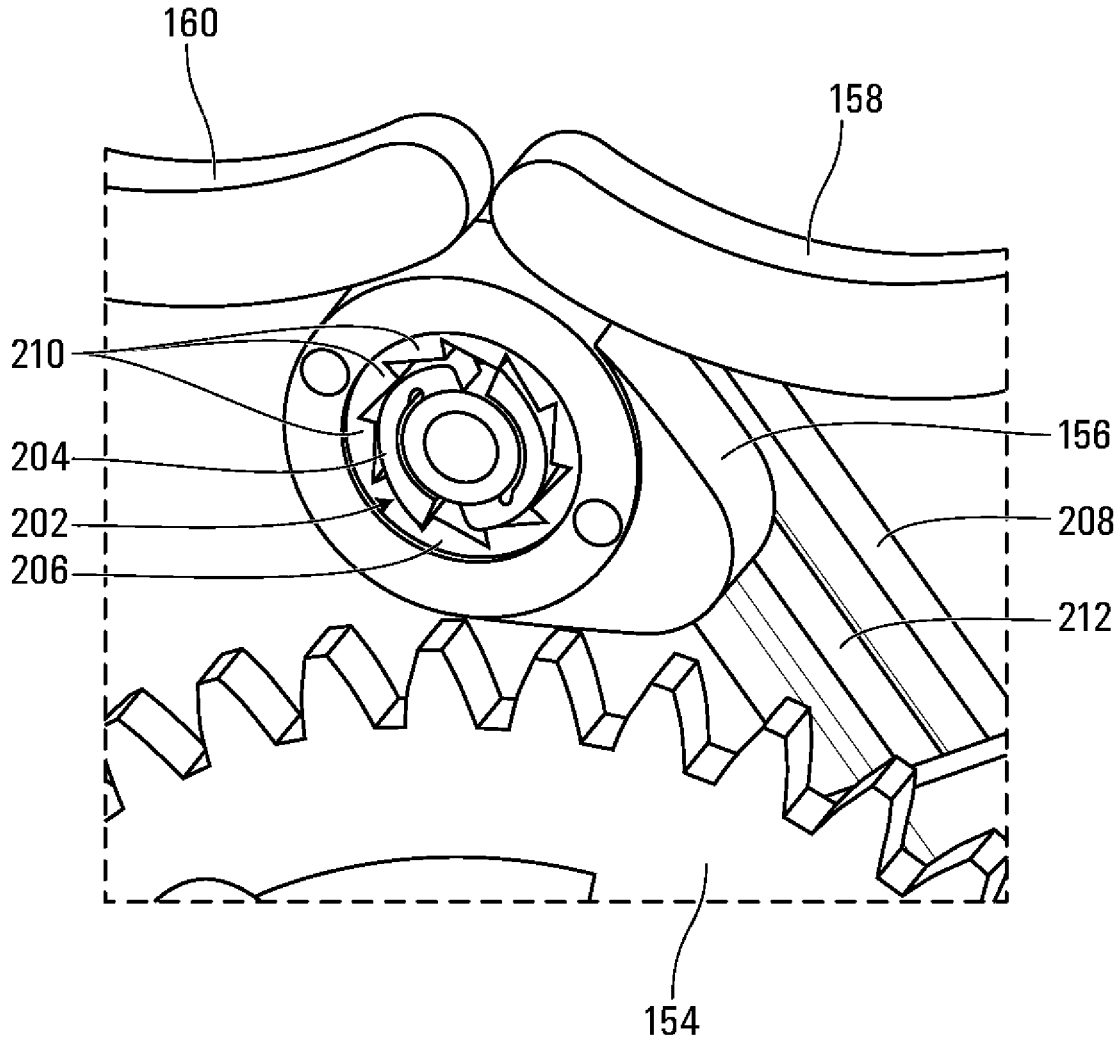
Figure 26:
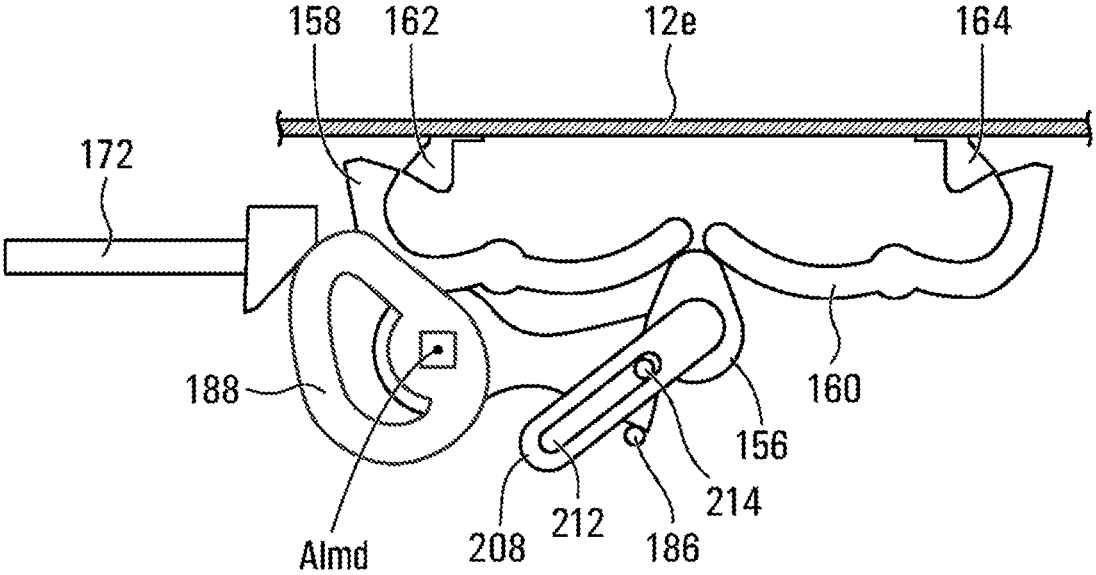

In order to move the fastener locking member 172 back and forth between the fastener locking position and the fastener release position, the final gear 154 has a drive pin 186 thereon, that engages a locking member driver 188 during rotation of the final gear 154 though a selected angular range. The locking member driver 188 moves angularly about a locking member driver axis Almd between a first locking member driver position (FIG. 24) in which the locking member driver 188 causes the fastener locking member 172 to move to the fastener release position (FIG. 24) and a second locking member driver position (FIG. 23), in which the locking member driver 188 causes the fastener locking member 172 to move to the fastener locking position (FIG. 23). The locking member driver 188 may have a cam portion 188*a* that engages the fastener locking member 172, and a pin engagement arm 188*b* that is engageable with the drive pin 186 on the final gear 154. The locking member driver 188 may be biased towards the second locking member driver position by a locking member driver biasing member 190, which may, for example, be a torsion spring or any other suitable type of biasing member.

Initially, as shown in FIG. 23, the locking member driver 188 may be in the second locking member driver position, the fastener locking member 172 may be in the fastener locking position and the final gear 154 is positioned such that the drive pin 186 has not yet engaged the pin engagement arm 188*b* on the locking member driver 188. During rotation of the final gear 154 through the selected angular range, the drive pin 186 engages and drives the locking member driver 188 to pivot from the second locking member driver position shown in FIG. 23 towards the first locking member driver position shown in FIG. 24. As a result, the locking member driver 188 drives the fastener locking member 172 from the fastener locking position (FIG. 23) to the fastener release position (FIG. 24), thereby releasing the fastener 166 (i.e. thereby permitting the fastener driver 178 to drive the fastener 166 towards discharge from the receiving aperture 170). Continued rotation of the final gear 154 moves the drive pin 186 past the point where it engages the locking member driver 188 (outside of the selected angular range), at which point the locking member driver biasing member 190 drives the locking member driver 188 back to the second locking member driver position, which in turn permits the fastener locking member 172 to be moved by the fastener locking member biasing member 182 back to the fastener locking position.

Continued rotation of the final gear 154 through several revolutions by the motor 24 through the drive arrangement 152 eventually releases the fastener 166 as described above, such that the fastener driver 178 drives the fastener from the housing 12, optionally with sufficient force to drive the fastener 166 into the air outside of the housing 12. The fastener 166 may be used to hold one of the sides of the housing with the top of the housing 12. For example, in the embodiment shown, the fastener 166 holds the third side 12*c* to the top 12*e* of the housing 12. To achieve this, the third side 12*c* includes a wall 192 and a top flap 194, whereas the top 12*e* may simply be a wall. The fastener 166, when the housing 12 is closed, passes through fastener apertures in the top 12*e* and the top flap 194 to hold the third side 12*c* to the top 12*e*. The apertures in the top 12*e* and the top flap 194 together make up the receiving aperture 170. Similarly, the fastener 168 passes through fastener apertures in the top 12*e* and the top flap 194 of the second side 12*b*, so as to hold the second side 12*b* to the top 12*e*.

Referring to FIG. 22, the opening mechanism 19 further includes a second fastener locking member 198 that works with the second fastener 168 in the same way that the fastener locking member 172 (which may be referred to as the first fastener locking member 172) works with the first fastener 166. A second locking member driver 200 may be provided, which works with the second fastener locking member 198 in the same way that the locking member driver 188 (which may be referred to as the first locking member driver 188) works with the first fastener locking member 172. The drive pin 186 on the final gear 154 engages the second locking member driver 200 through a second selected angular range of positions of the final gear 154 to drive the second locking member driver 200 to drive the second fastener locking member 198 in the same way that the drive pin 186 drives the first locking member driver 188 to drive the first fastener locking member 172.

The operation of the opening mechanism 19 with respect to the first and second latches 158 and 160 will now be described. The latch cam 156 employs a ratchet mechanism 202 (FIG. 25) internally, that permits it to be driven to rotate in a first direction only (clockwise in the views shown in FIGS. 22-24, counterclockwise in the view shown in FIG.

25). The ratchet mechanism 202 includes a pawl 204 and a ratchet 206. In the embodiment shown, the pawl 204 is connected to an arm (which may be referred to as a latch cam drive arm), shown at 208, and the ratchet 206, which is a ring of ratchet teeth 210, is on the latch cam 156. Rotation of the pawl 204 in the first direction engages the teeth 210, while rotation of the pawl 204 in the opposite direction cause the arms of the pawl 204 to slide over the teeth 210.

The latch cam drive arm 208 contains a drive slot 212. A latch cam drive pin 214 may be provided on the first locking member driver 188, and extends in the drive slot 212. Each time the first locking member driver 188 is pivoted to the first locking member driver position, it drives rotation of the latch cam 156 by a selected amount. Then, when the first locking member driver 188 pivots back to the second locking member driver position, the latch cam 156 remains at its new position due to the lack of power transfer through the ratchet mechanism 202. After a selected number of rotations of the final gear (the number of rotations being sufficient to have already caused ejection of the first and second fasteners 166 and 168 from the housing 12), the latch cam 156 pivots sufficiently to disengage both the first and second latches 158 and 160 from the first and second housing locking elements 162 and 164 on the top 12*e* of the housing 12, thereby permitting the housing 12 to open, and move to the position shown in FIG. 21, which in turn permits the inner object 14 to drive out of the housing 12 or to at least drive away from its storage position.

The opening mechanism 19 shown in FIGS. 22-26 may be provided in a separate chamber, which may be referred to as a fastener ejection mechanism chamber 216 or a latch release chamber 216. A drum chamber 28 may be provided, and may draw power from a connection to the gear arrangement 152, and may employ one or more tethers (not shown in FIGS. 22-26) to open a set of at least one removable housing portion 18, which may, for example, include a panel on the front 12*a* of the housing 12.

Referring to FIG. 22, an alternative impact mechanism is shown, and includes a first impactor member 218 that is separate from the opening member (which in the example embodiment shown in FIGS. 22-26 could be considered latch cam 156, either of the fastener locking members 172 or 198, or the one or more tethers 40 that are mentioned above as being optionally provided), and that is connected to the motor 24 to be driven by the motor 24 between an impact position (shown in FIG. 22) in which the impactor member 218 impacts at least one of the housing 12 and the support surface S on which the housing 12 rests to cause the housing 12 to move on the support surface S and a non-impact position (shown in dashed lines at 218*a* in FIG. 22) in which the impactor member 218 is spaced from the at least one of the housing 12 and the support surface S. In the example embodiment shown in FIG. 22, the impactor member 218 is connected to an impactor gear 220. An impactor member biasing member 222 (e.g. a torsion spring) urges the impactor member 218 towards the impact position. The motor 24 (FIG. 16) is connected to an impactor gear drive gear 224 (e.g. via the housing input gear 78), which is in turn engaged with the impactor gear 220. The impactor gear drive gear 224 may be a sector gear that drives the impactor gear 220 to move the impactor member 218 to the non-impact position, such that continued rotation of the motor 24 drives the sector gear past the impactor gear 220 so as to permit the impactor member biasing member 222 to drive the impactor member 218 towards the impact position. In the present example, when the impactor member 218 is in the impact position, the impactor member 218 impacts a bottom 12*f* of the housing 12.

A second impactor member is shown at 226 and is driven by the motor 24 via the housing input shaft 78 in the same way as the impactor member 218.

Any of the gears that are driven directly or indirectly by the housing input shaft 78 may include a ratchet mechanism that is similar to the ratchet mechanism 202 for one or more purposes.

While the inner object is shown as a vehicle 109, it will be understood that the inner object 14 could alternatively be any other suitable configuration that employs one or more drive wheels 122. For example, the inner object could be in the form of an animal such as a dog, with a drive wheel 122 at the end of each leg, in place of its feet.

While the final gear 154 has been described as a gear, this is just an example of a suitable rotary member that it could be. It could alternatively be any other type of rotary member such as a friction wheel that frictionally engages other friction wheels instead of gears, or a pulley that engages other pulleys via one or more belts, or any other suitable type of rotary member.

As noted above, the tethers 40 may be more broadly referred to as opening members that are positioned in the housing 12 and are positioned to open the housing 12 to expose the inner object 14. However, in alternative embodiments, the opening mechanism 19 need not incorporate tethers, and could instead be a completely different type of opening mechanism, such as for example any of the opening mechanisms shown in U.S. Pat. No. 9,950,267, which is incorporated herein by reference in its entirety. In U.S. Pat. No. 9,950,267 the opening mechanisms are referred to as breakout mechanisms, because they open the housing described therein by breaking the housing. Regardless of how the housing is opened, (e.g. whether by tearing as described herein, or whether by breakage as described in U.S. Pat. No. 9,950,267), the mechanism by which the housing is opened may be referred to as an opening mechanism. Similarly, the member that causes the opening to occur may be referred to as the opening member. In U.S. Pat. No. 9,950,267, the opening member may be the element referred to as the hammer (shown at 30 in that patent), or the plunger member (shown at 316 in that patent), for example.

In such an embodiment, the housing would preferably be made from a material such as is disclosed in U.S. Pat. No. 9,950,267 instead of a cardboard material. It will be understood that several aspects of the toy assembly 10 shown and described are advantageous regardless of whether they employ the opening mechanism shown in the figures, or whether they employ a different opening mechanism such as any of the breakout mechanisms described in U.S. Pat. No. 9,950,267. For example, it is advantageous to provide toy assembly 10 with any of the opening mechanisms and opening members described either directly herein, or in U.S. Pat. No. 9,950,267, in which there is provided any of the impactor members described herein, which are separate from the opening member of the opening mechanism, and which cause movement of the housing 12 on a support surface, without breaking of the housing 12. In another example, it is advantageous to provide the toy assembly 10, wherein, initially the inner object 14 is in a storage position in the housing 12 and the housing 12 is closed, and rotation of the motor 24 drives the opening members (i.e. any one or more of the tethers 40) to open the housing 12, and form the departure path 142 out of the housing 12 for the inner object 14, and wherein after the housing 12 is open, rotation of the motor 24 drives the inner object travel mechanism 110 and the one or more drive wheels 122 to move the inner object 14 away from the storage position and along the departure path 142 out of the housing.

Persons skilled in the art will appreciate that there are yet more alternative implementations and modifications possible, and that the above examples are only illustrations of one or more implementations. The scope, therefore, is only to be limited by the claims appended hereto.

What is claimed is:

1. A toy assembly, comprising:

a housing having a main housing portion, and a first set of at least one removable housing portion that is at least partially removable from the main housing portion;

a first series of eyelets mounted to the first set of at least one removable housing portion;

an inner object inside the housing;

a motor that is connected to drive at least one drum;

a first anchor having a first anchor slot having a first exit and a second exit;

a first tether having a free end which has an engagement member that is unable to pass through the first exit of the first anchor slot but can pass through the second exit of the first anchor slot, wherein the first tether passes sequentially through each of the series of eyelets between the at least one drum and the first anchor;

wherein, in an initial state the engagement member is positioned in the first anchor slot at the first exit of the first anchor slot, wherein, for each eyelet in succession in the first series of eyelets, a first segment of the first tether is angled relative to the eyelet and a final segment of the first tether is angled relative to the first anchor slot such that rotation of the motor to wind the first tether on the at least one drum pulls the free end of the first tether towards the first exit of the first anchor slot, and applies a first removal force on each eyelet in succession, wherein the first removal force is sufficiently strong to remove a portion of the first set of at least one removable housing portion from the main housing portion, and wherein after applying the first removal force to a final eyelet from the first series of eyelets, the first tether is angled such that rotation of the motor to wind the first tether on the at least one drum pulls the free end of the first tether towards and through the second exit of the first anchor slot, so as to remove the first tether from the first anchor.

2. A toy assembly as claimed in claim 1, wherein the housing defines a main chamber in which the inner object is positioned, and a drum chamber containing the at least one drum, wherein the drum chamber is separated from the main chamber and communicates with the main chamber via a tether pass-through aperture, through which the first tether passes, and wherein the first anchor is on the main housing portion, and continued rotation of the motor after the first tether passes through the second exit winds the first tether on the at least one drum until the free end of the first tether leaves the main chamber through the first tether pass-through aperture.

3. A toy assembly as claimed in claim 2, wherein the drum chamber is separated from the main chamber by a platform on which the inner object sits.

4. A toy assembly as claimed in claim 1, wherein the housing is in the form of a box.

5. A toy assembly as claimed in claim 4, wherein the housing has a first side, a second side, a third side and a fourth side, wherein the fourth side is opposite the first side, and the second side connects the first and fourth sides, and the third side is opposite the second side and also connects the first and fourth sides, wherein, for each side of the first, second, third and fourth sides, the housing further includes a side corner connecting said each side with any of the first, second, third and fourth sides that are adjacent to said each side, and wherein the housing includes a top, wherein the fourth side is disconnected from the top along a line of disconnection having a first end and a second end, wherein the second side has a second-side tear strip extending between the first end of the line of disconnection and the first side;

wherein the third side has a third-side tear strip extending between the second end of the line of disconnection and the first side;

wherein the second-side tear strip is a first removable housing portion of the first set of at least one removable housing portion, wherein the third-side tear strip is a first removable housing portion of a second set of at least one removable housing portion, wherein the toy assembly further comprises a second series of eyelets mounted to the second set of at least one removable housing portion;

wherein the toy assembly further comprises a second anchor on the main housing portion, wherein the second anchor has a second anchor slot having a first exit and a second exit;

wherein the toy assembly further comprises a second tether having a free end which has an engagement member that is unable to pass through the first exit of the second anchor slot but can pass through the second exit of the second anchor slot, wherein the second tether passes sequentially through each of the second series of eyelets between the at least one drum and the second anchor;

wherein, in the initial state the engagement member of the second tether is positioned in the second anchor slot at the first exit of the second anchor slot, wherein, for each eyelet in succession in the second series of eyelets, a first segment of the second tether is angled relative to the eyelet and a final segment of the second tether is angled relative to the second anchor slot such that rotation of the motor to wind the second tether on the at least one drum pulls the free end of the second tether towards the first exit of the second anchor slot, and applies a second removal force on each eyelet in succession, wherein the second removal force is sufficiently strong to remove a portion of the second set of at least one removable housing portion, and wherein after applying the second removal force to a final eyelet from the second series of eyelets, the second tether is angled such that rotation of the motor to wind the second tether on the at least one drum pulls the free end of the second tether towards and through the second exit of the second anchor slot, so as to remove the second tether from the second anchor.

6. A toy assembly as claimed in claim 5, wherein the toy assembly further comprises a first side drive structure that is positioned to drive the first side to bend away from the main chamber so as to expose the inner object once the first and second sets of at least one removable housing portion have been at least partially removed from the main housing portion.

7. A toy assembly as claimed in claim 6, wherein the first side drive structure includes at least one biasing member positioned to urge the first side to bend away from the main chamber.

8. A toy assembly as claimed in claim 5, wherein the inner object is a toy character that faces the first side.

9. A toy assembly as claimed in claim 5, wherein each of the second-side tear strip and the third-side tear strip is defined by a first tear line and a second tear line and wherein each of the first and second tear lines includes a plurality of cut segments that extend at least partially through a thickness of the housing, and which are separated from one another by a plurality of bridges.

10. A toy assembly as claimed in claim 9, wherein a ratio of a length of each of the plurality of cut segments to a length of each subsequent bridge is at least 7:2.

11. A toy assembly as claimed in claim 9, wherein the at least one tear line includes at least one tear line corner, and wherein every one of the at least one tear line corner is defined in the plurality of cut segments and not in any of the bridges.

12. A toy assembly as claimed in claim 9, wherein each of the second-side tear strip and the third-side tear strip includes at least one line of weakness that extends between the first tear line and the second tear line and is a fold line for each of the second-side tear strip and the third-side tear strip during tearing of each of the second-side tear strip and the third-side tear strip from the main housing portion.

13. A toy assembly as claimed in claim 4, wherein the inner object is in the form of four-legged animal.

14. A toy assembly as claimed in claim 1, wherein the inner object is removable from the housing and wherein the motor is inside the inner object and is operatively connected to a movable element of the inner object so as to drive movement of the movable element of the inner object.

15. A toy assembly as claimed in claim 1, wherein the inner object is removable from the housing and wherein the motor is inside the inner object, and wherein the housing includes a housing input member thereon, and a housing electrical terminal in the housing is in electrical communication with an inner object electrical terminal that is part of the inner object, so as to communicate actuation of the housing input member to a controller in the inner object, wherein the controller is connected to the motor to control operation of the motor based on actuation of the housing input member.

16. A toy assembly as claimed in claim 15, wherein the motor drives an inner object output shaft that is inside the inner object, and wherein the drum is in the housing and outside of the inner object, wherein the housing includes a housing input shaft that is operatively connected to the drum, wherein the housing input shaft removably extends into the inner object to engage the inner object output shaft such that rotation of the motor drives rotation of the drum.

17. A toy assembly as claimed in claim 16, wherein one of the housing electrical terminal and the inner object electrical terminal is a male terminal, and the other of the housing electrical terminal and the inner object electrical terminal is a female terminal into which the male terminal fits.

18. A toy assembly as claimed in claim 17, wherein the male terminal extends through a central passage in the housing input shaft and into the female terminal which is in the inner object.

19. A toy assembly as claimed in claim 18, wherein the female terminal is provided on a female terminal projection which passes at least partially through a central aperture in the inner object output shaft.

20. A toy assembly as claimed in claim 1, wherein each eyelet from the series of eyelets has a base and a loop structure, wherein the base is positioned on an exterior of the housing and the loop structure extends from the base through an eyelet pass-through aperture in the housing into the main chamber, wherein the base is larger than the eyelet pass-through aperture so as to prevent the base from being pulled through the eyelet pass-through aperture during applying of the first removal force on said each eyelet from the series of eyelets.

* * * * *